US010461433B2

(12) United States Patent
Smith et al.

(10) Patent No.: US 10,461,433 B2
(45) Date of Patent: Oct. 29, 2019

(54) METAMATERIALS FOR SURFACES AND WAVEGUIDES

(75) Inventors: David R. Smith, Durham, NC (US); Ruopeng Liu, Durham, NC (US); Tie Jun Cui, Nanjing (CN); Qiang Cheng, Nanjing (CN); Jonah N. Gollub, San Diego, CA (US)

(73) Assignee: Duke University, Durham, NC (US)

( * ) Notice: Subject to any disclaimer, the term of this patent is extended or adjusted under 35 U.S.C. 154(b) by 1087 days.

(21) Appl. No.: 12/545,373

(22) Filed: Aug. 21, 2009

(65) Prior Publication Data

US 2010/0156573 A1 Jun. 24, 2010

Related U.S. Application Data

(60) Provisional application No. 61/091,337, filed on Aug. 22, 2008.

(51) Int. Cl.

| | |
|---|---|
| ***H01Q 1/24*** | (2006.01) |
| ***H01Q 15/04*** | (2006.01) |
| ***H01P 3/08*** | (2006.01) |
| ***H01P 1/20*** | (2006.01) |
| ***H01Q 15/00*** | (2006.01) |
| ***H01Q 3/44*** | (2006.01) |

(52) U.S. Cl.

CPC ..... *H01Q 15/04* (2013.01); *H01P 1/2005* (2013.01); *H01P 3/081* (2013.01); *H01Q 3/44* (2013.01); *H01Q 15/0086* (2013.01)

(58) Field of Classification Search

USPC ..... 343/700 MS, 846, 909, 702; 333/239

See application file for complete search history.

(56) References Cited

U.S. PATENT DOCUMENTS

| | | | | |
|---|---|---|---|---|
| 6,859,114 | B2 | 2/2005 | Eleftheriades et al. | |
| 6,985,118 | B2 * | 1/2006 | Zarro et al. | 343/756 |
| 7,474,456 | B2 * | 1/2009 | Wang et al. | 359/315 |
| 7,522,124 | B2 | 4/2009 | Smith et al. | |
| 7,538,946 | B2 | 5/2009 | Smith et al. | |
| 7,545,242 | B2 * | 6/2009 | Beausoliel et al. | 333/239 |
| 7,545,841 | B2 * | 6/2009 | Wang et al. | 372/50.22 |
| 7,561,320 | B2 * | 7/2009 | Wang et al. | 359/238 |
| 7,580,604 | B2 * | 8/2009 | D'Aguanno et al. | 385/129 |
| 7,593,170 | B2 * | 9/2009 | Wu et al. | 359/719 |

(Continued)

OTHER PUBLICATIONS

Hand, Thomas H., et al., "Characterization of complementary electric field coupled resonant surfaces," Physics Applied Letters 93, 212504 (2008).

(Continued)

*Primary Examiner* — Jessica Han
*Assistant Examiner* — Hai Tran
(74) *Attorney, Agent, or Firm* — Olive Law Group, PLLC

(57) ABSTRACT

Complementary metamaterial elements provide an effective permittivity and/or permeability for surface structures and/or waveguide structures. The complementary metamaterial resonant elements may include Babinet complements of "split ring resonator" (SRR) and "electric LC" (ELC) metamaterial elements. In some approaches, the complementary metamaterial elements are embedded in the bounding surfaces of planar waveguides, e.g. to implement waveguide based gradient index lenses for beam steering/focusing devices, antenna array feed structures, etc.

40 Claims, 26 Drawing Sheets

Wave-guided Complimentary Negative Index Metamaterials

(56) References Cited

U.S. PATENT DOCUMENTS

| | | | | |
|---|---|---|---|---|
| 7,629,937 | B2 * | 12/2009 | Lier et al. | 343/786 |
| 7,821,473 | B2 | 10/2010 | Justice et al. | |
| 7,928,900 | B2 * | 4/2011 | Fuller et al. | 342/175 |
| 8,026,862 | B2 | 9/2011 | Pendry et al. | |
| 8,633,861 | B2 | 1/2014 | De Luca et al. | |
| 8,773,776 | B2 | 7/2014 | Bowers et al. | |
| 2004/0066251 | A1 | 4/2004 | Eleftheriades et al. | |
| 2005/0200540 | A1 | 9/2005 | Isaacs et al. | |
| 2005/0225492 | A1 * | 10/2005 | Metz | H01P 3/08 343/753 |
| 2006/0022875 | A1 * | 2/2006 | Pidwerbetsky | H01Q 1/243 343/700 MS |
| 2007/0188385 | A1 * | 8/2007 | Hyde | H01Q 15/002 343/700 MS |
| 2007/0267406 | A1 | 11/2007 | Thimm | |
| 2008/0024792 | A1 | 1/2008 | Pendry et al. | |
| 2008/0165079 | A1 * | 7/2008 | Smith | B82Y 20/00 343/911 R |
| 2008/0204164 | A1 | 8/2008 | Eleftheriades | |
| 2009/0109103 | A1 | 4/2009 | Pendry et al. | |
| 2010/0079217 | A1 * | 4/2010 | Morton | H01P 1/2005 333/24.2 |
| 2010/0156573 | A1 | 6/2010 | Smith et al. | |
| 2010/0301971 | A1 | 12/2010 | Yonak et al. | |
| 2011/0026624 | A1 | 2/2011 | Gummallia et al. | |

OTHER PUBLICATIONS

Schurig, D., et al., "Electric-field-coupled resonators for negative permittivity metamaterials," Applied Physics Letters 88, 041109 (2006).

Liu, Ruopeng, et al., "Gradient index circuit by waveguided metamaterials," Applied Physics Letters 94, 073506 (2009).

Smith, David R., et al., "Partial focusing of radiation by a slab of indefinite media," Applied Physics Letters, vol. 84, No. 13 (Mar. 29, 2004).

Gollub, Jonah N., et al., "Hybrid resonant phenomenon in a metamaterial structure with integrated resonant magnetic material," arXiv:0810.4871v1 [cond-mat.mtrl-sci] (Oct. 27, 2008).

Simovski, Constantin R., et al., "Frequency range and explicit expressions for negative permittivity and permeability for an isotropic medium formed by a lattice of perfectly conducting Ω particles," arXiv:physics/0210049v1 [physics.optics] (Oct. 11, 2002).

Getsinger, W.J., "Circuit Duals on Planar Transmission Media," Microwave Symposium Digest, MTT-S Internat., vol. 83, No. 1 (May 1983).

Lu, Mingzhi, et al., "A Microstrip Phase Shifter Using Complementary Metamaterials," ICMMT2008 Proceedings (2008).

Velez, Adolfo, et al., "Varactor-Loaded Complementary Split Ring Resonators (VLCSRR) and Their Application to Tunable Metamaterial Transmission Lines," IEEE Microwave and Wireless Components Letters, vol. 18, No. 1 (Jan. 2008).

Gil, Ignacio, et al., "Tunable Metamaterial Transmission Lines Based on Varactor-Loaded Split-Ring Resonators," IEEE Transactions on Microwave Theory and Techniques, vol. 54, No. 6 (Jun. 2006).

Rotman, W., et al., "Wide-Angle Microwave Lens for Line Source Applications," IEEE Transactions on Antennas and Propagation, vol. 11, Issue 6, pp. 623-632 (Nov. 1963).

Marques, R., et al., "Ab initio analysis of frequency selective surfaces based on conventional and complementary split ring resonators," Institute of Physics Publishing, Journal of Optics A: Pure and Applied Optics 7, S38-S43 (2005).

Bonache, Jordi, et al., Microstrip Bandpass Filters with Wide Bandwidth and Compact Dimensions, Microwave and Optical Technology Letters, vol. 46, No. 4 (Aug. 20, 2005).

Elek, Francis, et al., "A two-dimensional uniplanar transmission-line metamaterial with a negative index of refraction," New Journal of Physics 7, 163 (2005).

Chen, Hou-Tong, et al., "Complementary planar terahertz metamaterials," Optics Express, vol. 15, No. 3, pp. 1084-1095 (Feb. 5, 2007).

Justice, Bryan J., et al., "Spatial mapping of the internal and external electromagnetic fields of negative index metamaterials," Optics Express, vol. 14, No. 19, pp. 8694-8705 (Sep. 18, 2006).

Dolling, G., et al., "Cut-wire pairs and plate pairs as magnetic atoms for optical metamaterials," Optics Letters, vol. 30, No. 23, pp. 3198-3200 (Dec. 1, 2005).

Cheng, Qiang, et al., "Partial focusing by indefinite complementary metamaterials," Physical Review B 78, 121102 (R) (2008).

Falcone, F., "Babinet Principle Applied to the Design of Metasurfaces and Metamaterials," Physical Review Letters, vol. 93, No. 19 (Nov. 5, 2004).

Liu, Ruopeng, et al., "Experimental Demonstration of Electromagnetic Tunneling Through an Epsilon-Near-Zero Metamaterial at Microwave Frequencies," Physical Review Letters 100, 023903 (Jan. 18, 2008).

Liu, R., et al., "Broadband Ground-Plane Cloak," Science, vol. 323 (Jan. 16, 2009).

Publications of Professor David R. Smith and Group, Metamaterial Publications from Metagroup, http://people.ee.duke.edu/~drsmith/pubs_smith.htm (2006).

News Releases, Feature Stories and Profiles about Duke University's Pratt School, "Theoretical Blueprint for Invisibility Cloak Reported" (May 25, 2008).

Wikipedia, Metamaterial, 5 pages (Sep. 7, 2007).

Chang, Kenneth, Science Times, The New York Times, "Light Fantastic" (Jun. 12, 2007).

International Search Report and Written Opinion of the International Searching Authority received in corresponding PCT Application No. PCT/US2009/004772 (Apr. 12, 2010).

Kern, D.J., "The Design Synthesis of Multiband Artificial Magnetic Conductors Using High Impedance Frequency Selective Surface," IEEE Trans. on Antennas and Propagation, vol. 53, No. 1 (Jan. 2005).

Schurig, D., et al., "Metamaterial Electromagnetic Cloak at Microwave Frequencies," Science 314, 977 (Nov. 10, 2006).

Alu et al., "Metamaterial Covers Over a Small Aperture," IEEE Trans. on Antennas and Propagation, vol. 54, No. 6 (Jun. 2006).

Alu et al., "Single-Negative, Double-Negative, and Low-index Metamaterials and their Electromagnetic Applications," IEEE Trans. on Antennas and Propagation, vol. 49 No. 1 (Feb. 2007).

R. A. Shelby, D. R. Smith, and S. Schultz, "Experimental Verification of a Negative Index of Refraction," Science 292 (5514), 77-79 (2002).

J. B. Pendry, A. J. Holden, D. J. Robbins, and W. J. Stewart, "Magnetism from Conductors and Enhanced Non-Linear Phenomena," IEEE Trans. Microw. Theory Tech. 47(11), 2075-2084 (1999).

W. E. Kock, "Metallic delay lenses," Bell Syst. Tech. J. 27,58 (1948).

R. W. Corkum, "Isotropic artificial dielectric," Proceedings of the IRE 40(5), 574-587 (1952).

J. Brown, and W. Jackson, "The Properties of Artificial Dielectrics at Centimetre Wavelengths," Proc. IEE paper No. 1699R vol. 102B pp. 11-21, Jan. 1995.

I. Bahl and K. Gupta, "A leaky-wave antenna using an artificial dielectric medium," IEEE Trans. Antenn. Propag. 22(1), 119-122 (1974).

Y. Mukoh, T. Nojima, and N. Hasebe, "A reflector lens antenna consisting of an artificial dielectric," Electronics and Communications in Japan (1), 82 (1999).

I. Awai, H. Kubo, T. Iribe, D. Wakamiya, and A. Sanada, "An artificial dielectric material of huge permittivity with novel anisotropy and its application to a microwave BPF," in Microwave Symposium Digest, 2003 IEEE MTT-S International 2 1085-1088 (2003).

I. Awai, S. Kida, and O. Mizue, "Very Thin and Flat Lens Antenna Made of Artificial Dielectrics," in 2007 Korea-Japan Microwave Conference 177-180 (2007).

I. Awai, "Artificial Dielectric Resonators for Miniaturized Filters," IEEE Microw. Mag. 9(5), 55-64 (2008).

Y. Ma, B. Rejaei, and Y. Zhuang, "Radial Perfectly Matched Layer for the ADI-FDTD Method," IEEE Microw. Wirel. Compon. Lett. 19, 431-433 (2008).

(56) References Cited

OTHER PUBLICATIONS

J. B. Pendry, D. Schurig, and D. R. Smith, "Controlling electromagnetic fields," Science 312(5781), 1780-1782 (2006).
J. B. Pendry and S. A. Ramakrishna, "Focusing light with negative refractive index," J. Phys. Condens. Matter 15(37), 6345-6364 (2003).
S. Guenneau, B. Gralak, and J. B. Pendry, "Perfect corner reflector," Opt. Lett. 30(10), 1204-1206 (2005).
D. Schurig, J. J. Mock, B. J. Justice, S. A. Cummer, J. B. Pendry, A. F. Starr, and D. R. Smith, "Metamaterial electromagnetic cloak at microwave frequencies," Science 314(5801), 977-980 (2006).
R. Liu, T. J. Cui, D. Huang, B. Zhao, and D. R. Smith, "Description and explanation of electromagnetic behaviors in artificial metamaterials based on effective medium theory," Phys. Rev. E Stat. Nonlin. Soft Matter Phys. 76(2), 026606 (2007).
C. Kittel, Solid State Physics (John Wiley & Sons, New York, 1986), 6th ed., p. 275.
G. Dolling, C. Enkrich, M. Wegener, S. Linden, J. Zhou, and C. M. Soukoulis, "Cut-wire and plate capacitors as magnetic atoms for optical metamaterials," Opt. Lett. 30, 3198 (2005).
D. R. Smith, P. M. Rye, J. J. Mock, D. C. Vier, and A. F. Starr, "Enhanced diffraction from a grating on the surface of a negative-index metamaterial," Phys. Rev. Lett. 93(13), 137405 (2004).
M. J. Minot, "Single-layer, gradient refractive index antireflection films effective from 0.35 μm to 2.5 μm," J. Opt. Soc. Am. 66(6), 515-519 (1976).
R. Jacobson, "Inhomogeneous and coevaporated homogeneous films for optical applications," in Physics of Thin Films, G. Haas, M. Francombe, and R. Hoffman, eds. (Academic, New York, 1975), vol. 8, p. 51.
C. G. Snedaker, "New numerical thin-film synthesis technique," J. Opt. Soc. Am. 72, 1732 (1982).
B. J. Justice, J. J. Mock, L. Guo, A. Degiron, D. Schurig, and D. R. Smith, "Spatial mapping of the internal and external electromagnetic fields of negative index metamaterials," Opt. Express 14(19), 8694-8705 (2006).
J. Li and J. B. Pendry, "Hiding under the Carpet: a New Strategy for Cloaking," Phys. Rev. Lett. 101(20), 203901 (2008).
R. Liu, C. Ji, J. J. Mock, J. Y. Chin, T. J. Cui, and D. R. Smith, "Broadband ground-plane cloak," Science 323(5912), 366-369 (2009).
Marques, R., et al., "Left-Handed-Media Simulation and Transmission of EM Waves in Subwavelength Split-Ring-Resonator-Loaded Metallic Waveguides," The American Physical Society, Physical Review Letters, Oct. 28, 2002, vol. 89, No. 18, pp. 183901-1-183901-4.
Office Action dated Mar. 26, 2015, issued in related U.S. Appl. No. 14/560,939.
U.S. Notice of Allowance for U.S. Appl. No. 14/560,939.
U.S. Non-Final Office Action dated Dec. 6, 2016 for U.S. Appl. No. 14/552,068.

* cited by examiner

Wave-guided Complimentary ELC (Magnetic Response)

Wave-guided Complimentary SRR (Electric Response)

Wave-guided Complimentary Negative Index Metamaterials

Wave-guided Complimentary Negative Index Metamaterials

Micro-strip Line Complimentary ELC

Micro-strip Line Negative Index Metamaterials

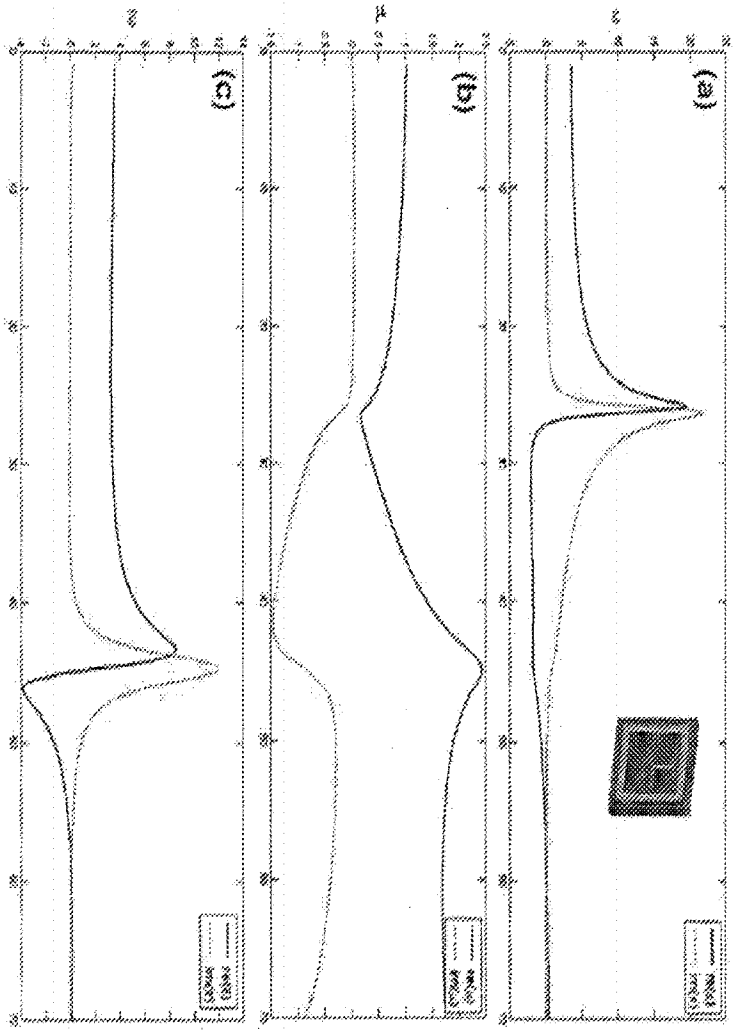
Fig. A1. (a), (b), (c).

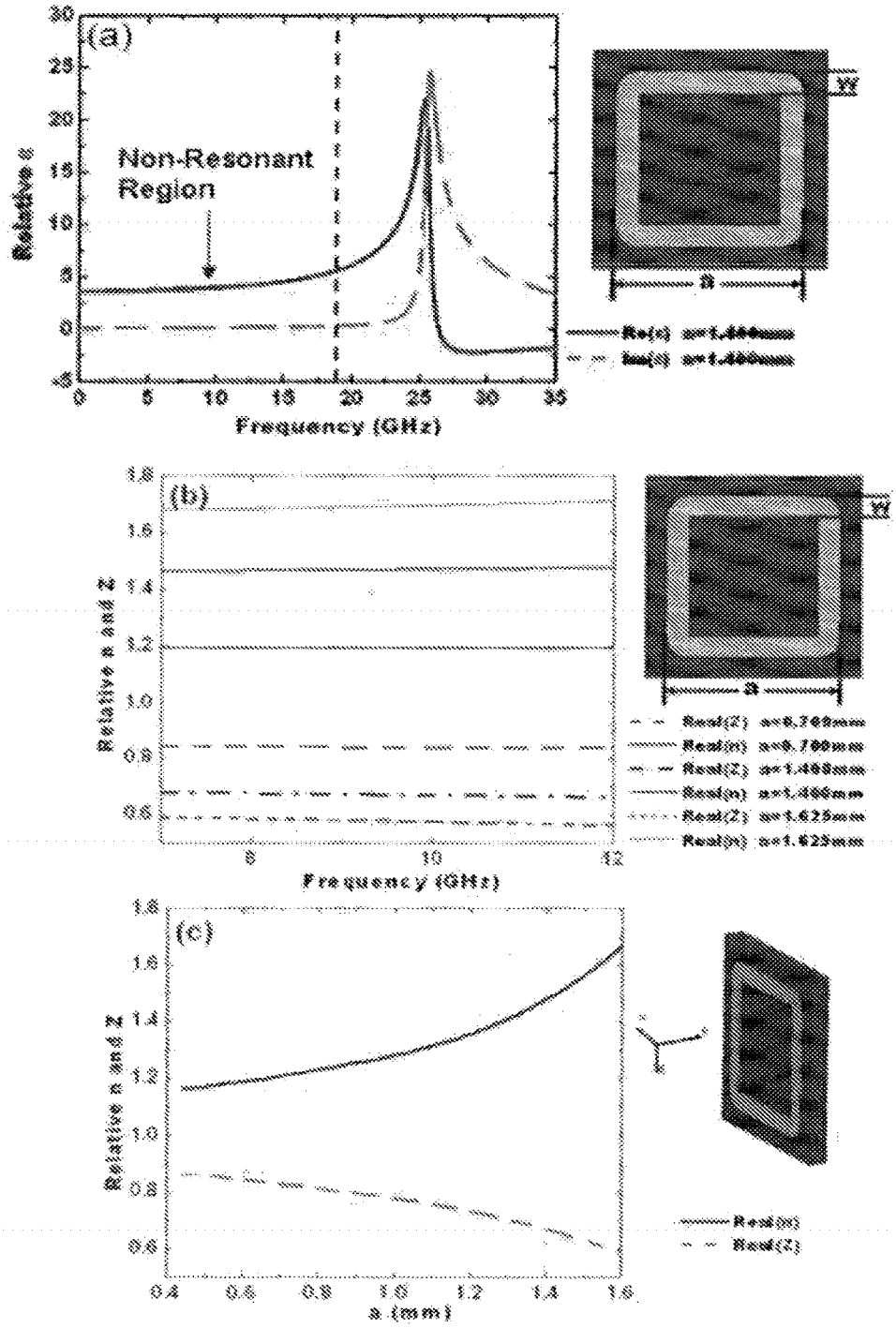
Fig. A2.

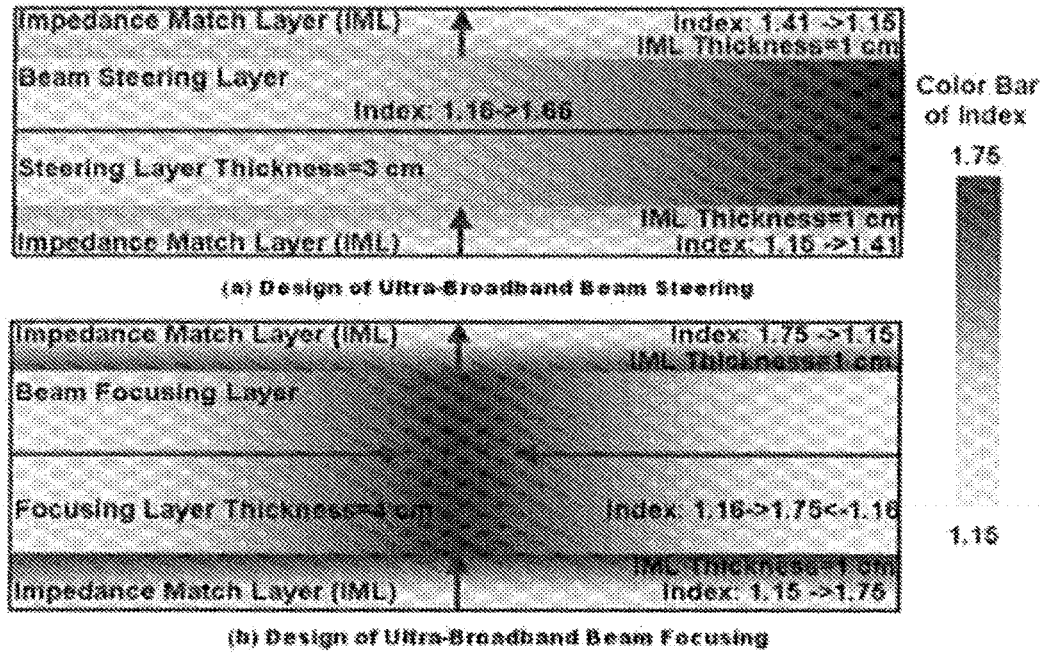
Fig. A3.
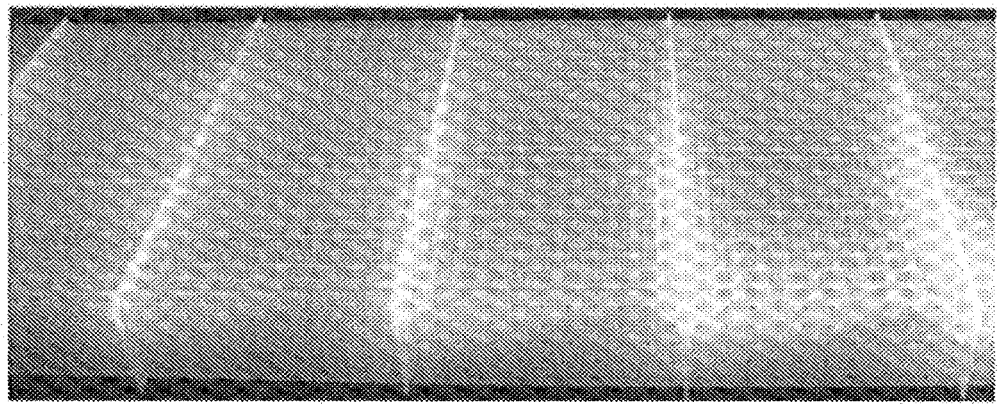
Fig. A4.

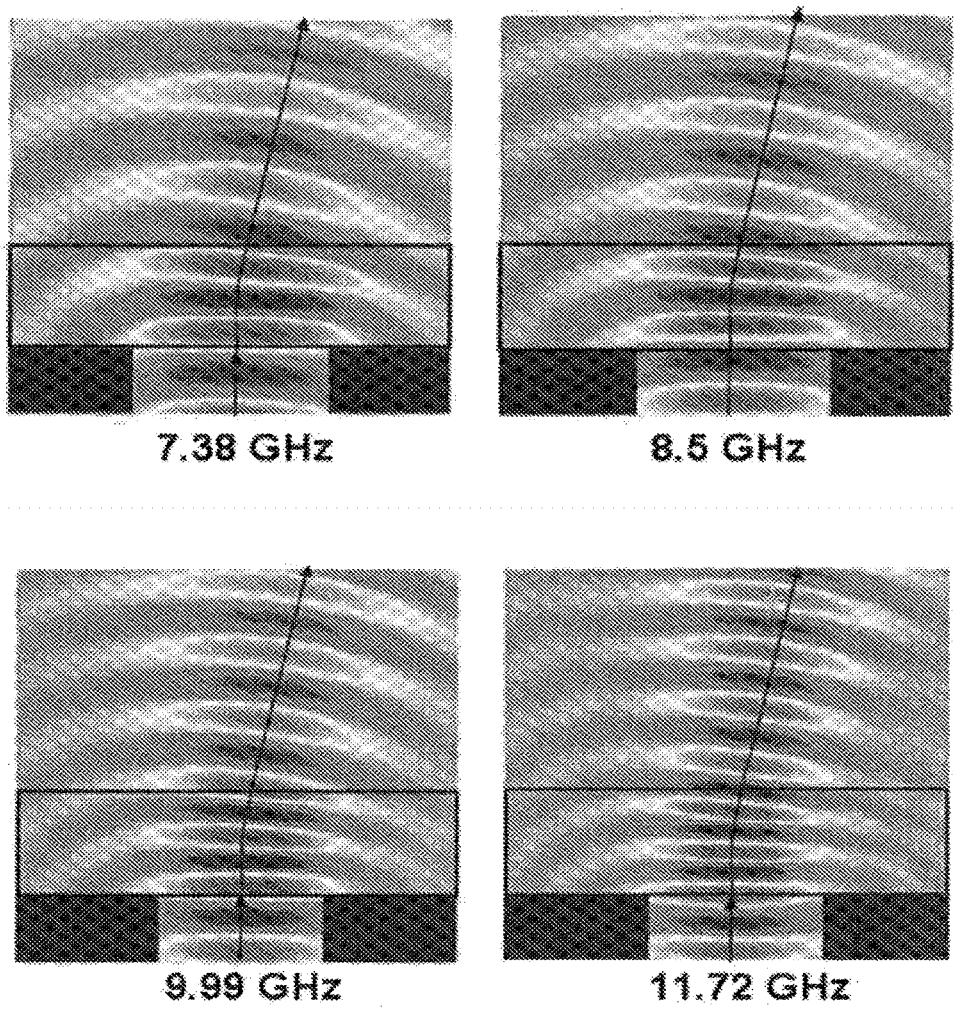
Fig. A5.

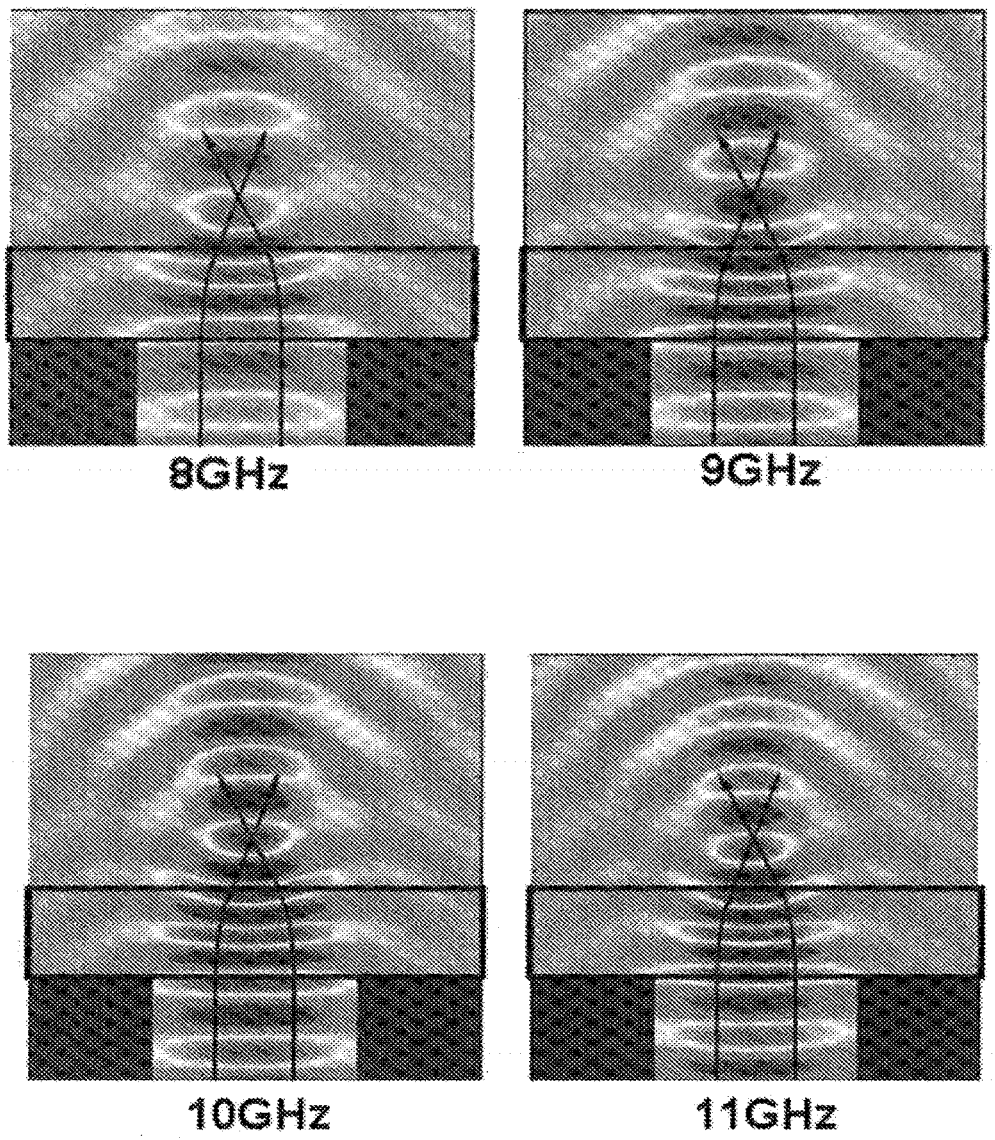
Fig. A6

METAMATERIALS FOR SURFACES AND WAVEGUIDES

CROSS-REFERENCES TO RELATED APPLICATIONS

This application claims the benefit of priority from provisional application No. 61/091,337 filed Aug. 22, 2008, incorporated herein by reference.

STATEMENT REGARDING FEDERALLY SPONSORED RESEARCH OR DEVELOPMENT

Not Applicable.

TECHNICAL FIELD

The technology herein relates to artificially-structured materials such as metamaterials, which function as artificial electromagnetic materials. Some approaches provide surface structures and/or waveguide structures responsive to electromagnetic waves at radio-frequencies (RF) microwave frequencies, and/or higher frequencies such as infrared or visible frequencies. In some approaches the electromagnetic responses include negative refraction. Some approaches provide surface structures that include patterned metamaterial elements in a conducting surface. Some approaches provide waveguide structures that include patterned metamaterial elements in one or more bounding conducting surfaces of the waveguiding structures (e.g. the bounding conducting strips, patches, or planes of planar waveguides, transmission line structures or single plane guided mode structures).

BACKGROUND AND SUMMARY

Artificially structured materials such as metamaterials can extend the electromagnetic properties of conventional materials and can provide novel electromagnetic responses that may be difficult to achieve in conventional materials. Metamaterials can realize complex anisotropies and/or gradients of electromagnetic parameters (such as permittivity, permeability, refractive index, and wave impedance), whereby to implement electromagnetic devices such as invisibility cloaks (see, for example, J. Pendry et al, "Electromagnetic cloaking method," U.S. patent application Ser. No. 11/459,728, herein incorporated by reference) and GRIN lenses (see, for example, D. R Smith et al, "Metamaterials," U.S. patent application Ser. No. 11/658,358, herein incorporated by reference). Further, it is possible to engineer metamaterials to have negative permittivity and/or negative permeability, e.g. to provide a negatively refractive medium or an indefinite medium (i.e. having tensor-indefinite permittivity and/or permeability; see, for example, D. R. Smith et al, "Indefinite materials," U.S. patent application Ser. No. 10/525,191, herein incorporated by reference).

The basic concept of a "negative index" transmission line, formed by exchanging the shunt capacitance for inductance and the series inductance for capacitance, is shown, for example, in Pozar, *Microwave Engineering* (Wiley 3d Ed.). The transmission line approach to metamaterials has been explored by Itoh and Caloz (UCLA) and Eleftheriades and Balmain (Toronto). See for example Elek et al, "A two-dimensional uniplanar transmission-line metamaterial with a negative index of refraction", New Journal of Physics (Vol. 7, Issue 1 pp. 163 (2005); and U.S. Pat. No. 6,859,114.

The transmission lines (TLs) disclosed by Caloz and Itoh are based on swapping the series inductance and shunt capacitance of a conventional TL to obtain the TL equivalent of a negative index medium. Because shunt capacitance and series inductance always exist, there is always a frequency dependent dual behavior of the TLs that gives rise to a "backward wave" at low frequencies and a typical forward wave at higher frequencies. For this reason, Caloz and Itoh have termed their metamaterial TL a "composite right/left handed" TL, or CRLH TL. The CRLH TL is formed by the use of lumped capacitors and inductors, or equivalent circuit elements, to produce a TL that functions in one dimension. The CRLH TL concept has been extended to two dimensional structures by Caloz and Itoh, and by Grbic and Eleftheriades.

Use of a complementary split ring resonator (CSRR) as a microstrip circuit element was proposed in F. Falcone et al., "Babinet principle applied to the design of metasurfaces and metamaterials," Phys. Rev. Lett. V93, Issue 19, 197401. The CSRR was demonstrated as a filter in the microstrip geometry by the same group. See e.g., Marques et al, "Ab initio analysis of frequency selective surfaces based on conventional and complementary split ring resonators", Journal of Optics A: Pure and Applied Optics, Volume 7, Issue 2, pp. S38-S43 (2005), and Bonache et al., "Microstrip Bandpass Filters With Wide Bandwidth and Compact Dimensions" (Microwave and Optical Tech. Letters (46:4, p. 343 2005). The use of CSRRs as patterned elements in the ground plane of a microstrip was explored. These groups demonstrated the microstrip equivalent of a negative index medium, formed using CSRRs patterned in the ground plane and capacitive breaks in the upper conductor. This work was extended to coplanar microstrip lines as well.

A split-ring resonator (SRR) substantially responds to an out-of-plane magnetic field (i.e. directed along the axis of the SRR). The complementary SRR (CSRR), on the other hand, substantially responds to an out-of-plane electric field (i.e. directed along the CSRR axis). The CSRR may be regarded as the "Babinet" dual of the SRR and embodiments disclosed herein may include CSRR elements embedded in a conducting surface, e.g. as shaped apertures, etchings, or perforation of a metal sheets. In some applications as disclosed herein, the conducting surface with embedded CSRR elements is a bounding conductor for a waveguide structure such as a planar waveguide, microstrip line, etc.

While split-ring resonators (SRRs) substantially couple to an out-of-plane magnetic field, some metamaterial applications employ elements that substantially couple to an in-plane electric field. These alternative elements may be referred to as electric LC (ELC) resonators, and exemplary configurations are depicted in D. Schurig et al, "Electric-field coupled resonators for negative permittivity metamaterials," Appl. Phys. Lett 88, 041109 (2006). While the electric LC (ELC) resonator substantially couples to an in-plane electric field, the complementary electric LC (CELC) resonator substantially responds to an in-plane magnetic field. The CELC resonator may be regarded the "Babinet" dual of the ELC resonator, and embodiments disclosed herein may include CELC resonator elements (alternatively or additionally to CSRR elements) embedded in a conducting surface, e.g. as shaped apertures, etchings, or perforations of a metal sheet. In some applications as disclosed herein, a conducting surface with embedded CSRR and/or CELC elements is a bounding conductor for a waveguide structure such as a planar waveguide, microstrip line, etc.

Some embodiments disclosed herein employ complementary electric LC (CELC) metamaterial elements to provide an effective permeability for waveguide structures. In various embodiments the effective (relative) permeability may be greater then one, less than one but greater than zero, or less than zero. Alternatively or additionally, some embodiments disclosed herein employ complementary split-ring-resonator (CSRR) metamaterial elements to provide an effective permittivity for planar waveguide structures. In various embodiments the effective (relative) permittivity may be greater then one, less than one but greater than zero, or less than zero.

Exemplary non-limiting features of various embodiments include:

- Structures for which an effective permittivity, permeability, or refractive index is near zero
- Structures for which an effective permittivity, permeability, or refractive index is less than zero
- Structures for which an effective permittivity or permeability is an indefinite tensor (i.e. having both positive and negative eigenvalues)
- Gradient structures, e.g. for beam focusing, collimating, or steering
- Impedance matching structures, e.g. to reduce insertion loss
- Feed structures for antenna arrays
- Use of complementary metamaterial elements such as CELCs and CSRRs to substantially independently configure the magnetic and electric responses, respectively, of a surface or waveguide, e.g. for purposes of impedance matching, gradient engineering, or dispersion control
- Use of complementary metamaterial elements having adjustable physical parameters to provide devices having correspondingly adjustable electromagnetic responses (e.g. to adjust a steering angle of a beam steering device or a focal length of a beam focusing device)
- Surface structures and waveguide structures that are operable at RF, microwave, or even higher frequencies (e.g. millimeter, infrared, and visible wavelengths)

BRIEF DESCRIPTION OF THE DRAWINGS

These and other features and advantages will be better and more completely understood by referring to the following detailed description of exemplary non-limiting illustrative implementations in conjunction with the drawings of which:

FIG. 8-1 depicts retrieved permittivity and permeability of a CSRR element, and FIG. 8-2 depicts the dependence of the retrieved permittivity and permeability on a geometrical parameter of the CSRR element;

FIGS. 9-1, 9-2 depict field data for 2D implementations of the planar waveguide structure for beam-steering and beam-focusing applications, respectively;

FIGS. 10-1, 10-2 depict an exemplary CELC array as a 2D planar waveguide structure providing an indefinite medium;

FIGS. 11-1, 11-2 depict a waveguide based gradient index lens deployed as a feed structure for an array of patch antennas; and FIGS. A1-A6 comprise Figures of the Appendix.

DETAILED DESCRIPTION

Figure 1:
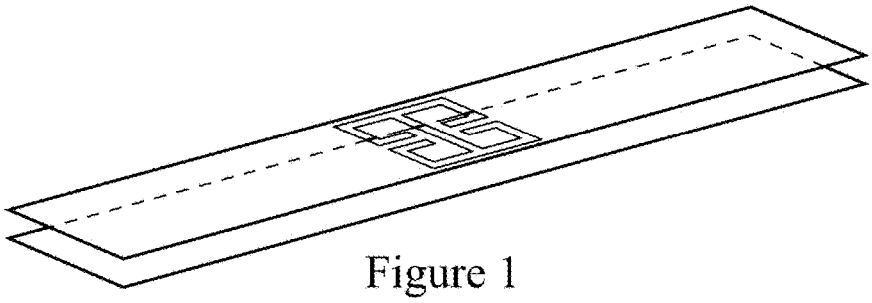
FIGS. 1-1D depict a wave-guided complementary ELC (magnetic response) structure (FIG. 1) and associated plots of effective permittivity, permeability, wave impedance, and refractive index (FIGS. 1A-1D)
Figure 1A:
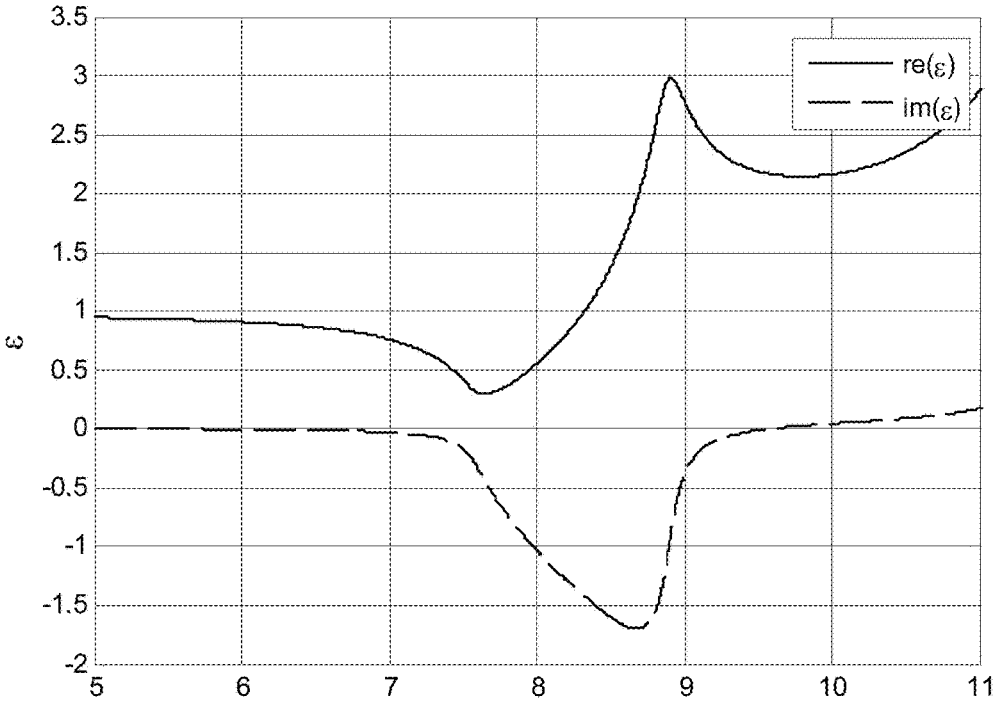
Figure 1B:
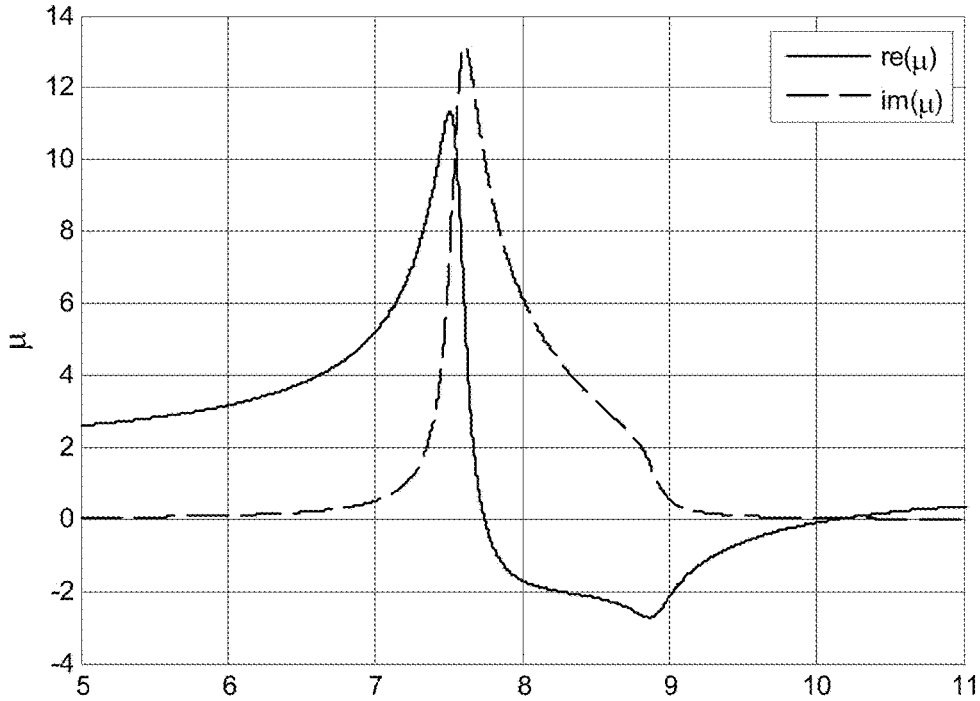
Figure 1C:
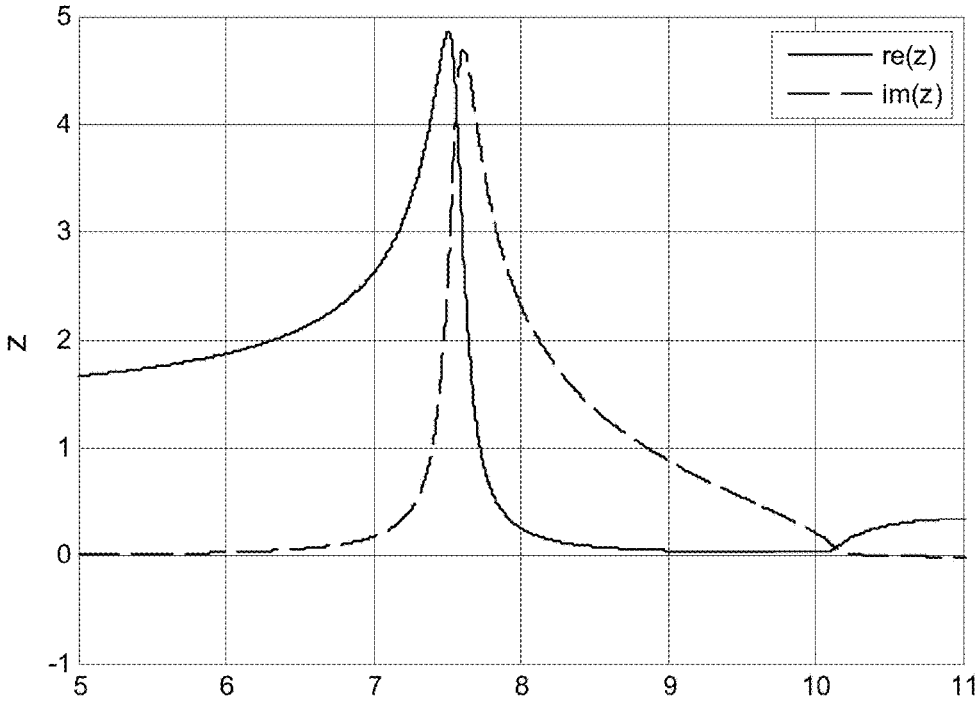
Figure 1D:
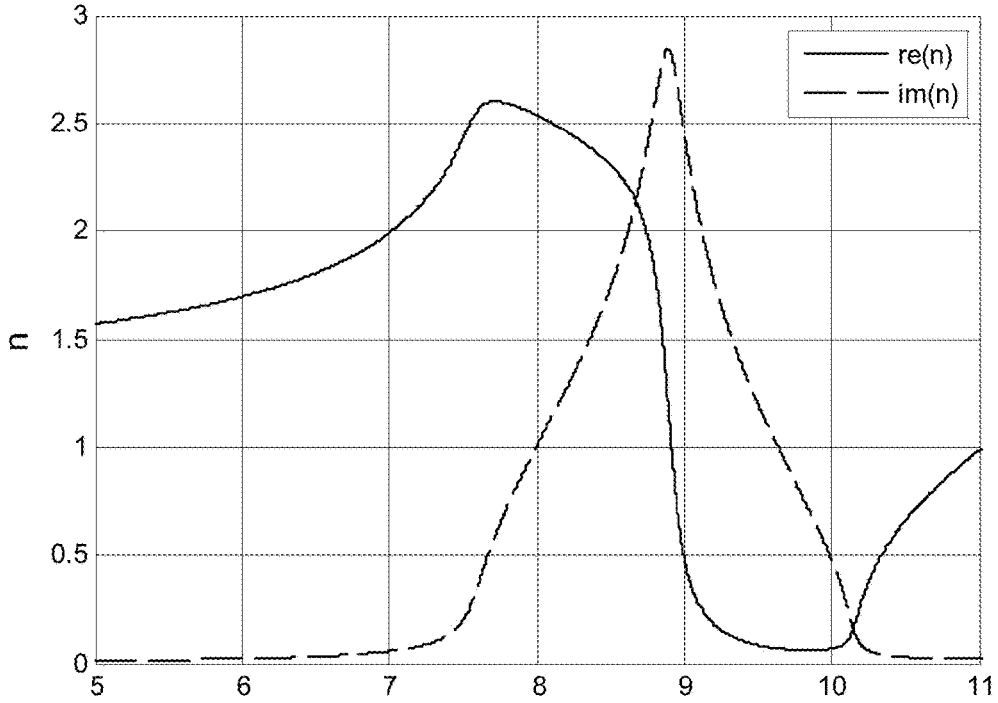

Various embodiments disclosed herein include "complementary" metamaterial elements, which may be regarded as Babinet complements of original metamaterial elements such as split ring resonators (SRRs) and electric LC resonators (ELCs).

The SRR element functions as an artificial magnetic dipolar "atom," producing a substantially magnetic response to the magnetic field of an electromagnetic wave. Its Babinet "dual," the complementary split ring resonator (CSRR), functions as an electric dipolar "atom" embedded in a conducting surface and producing a substantially electric response to the electric field of an electromagnetic wave. While specific examples are described herein that deploy CSRR elements in various structures, other embodiments may substitute alternative elements. For example, any substantially planar conducting structure having a substantially magnetic response to an out-of-plane magnetic field (hereafter referred to as a "M-type element," the SRR being an example thereof) may define a complement structure (hereafter a "complementary M-type element," the CSRR being an example thereof), which is a substantially-equivalently-shaped aperture, etching, void, etc. within a conducting surface. The complementary M-type element will have a Babinet-dual response, i.e. a substantially electric response to an out-of-plane electric field. Various M-type elements (each defining a corresponding complementary M-type element) may include: the aforementioned split ring resonators (including single split ring resonators (SSRRs), double split ring resonators (DSRRs), split-ring resonators having multiple gaps, etc.), omega-shaped elements (cf. C. R. Simovski and S. He, arXiv:physics/0210049), cut-wire-pair elements (cf. G. Dolling et al, Opt. Lett. 30, 3198 (2005)), or any other conducting structures that are substantially magnetically polarized (e.g. by Faraday induction) in response to an applied magnetic field.

The ELC element functions as an artificial electric dipolar "atom," producing a substantially electric response to the electric field of an electromagnetic wave. Its Babinet "dual," the complementary electric LC (CELC) element, functions as a magnetic dipolar "atom" embedded in a conducting surface and producing a substantially magnetic response to the magnetic field of an electromagnetic wave. While specific examples are described herein that deploy CELC elements in various structures, other embodiments may substitute alternative elements. For example, any substantially planar conducting structure having a substantially electric response to an in-plane electric field (hereafter referred to as a "E-type element," the ELC element being an example thereof) may define a complement structure (hereafter a "complementary E-type element," the CELC being an example thereof), which is a substantially-equivalently-shaped aperture, etching, void, etc. within a conducting surface. The complementary E-type element will have a Babinet-dual response, i.e. a substantially magnetic response to an in-plane magnetic field. Various E-type elements (each defining a corresponding complementary E-type element) may include: capacitor-like structures coupled to oppositely-oriented loops (as in FIGS. 1, 3, 4, 5, 6, and 10-1, with other exemplary varieties depicted in D. Schurig et al, "Electric-field-coupled resonators for negative permittivity metamaterials," Appl. Phys. Lett. 88, 041109 (2006) and in H.-T. Cen et al, "Complementary planar terahertz metamaterials," Opt. Exp. 15, 1084 (2007)), closed-ring elements (cf. R. Liu et al, "Broadband gradient index optics based on non-resonant metamaterials," unpublished; see attached Appendix), I-shaped or "dog-bone" structures (cf. R. Liu et al, "Broadband ground-plane cloak," Science 323, 366 (2009)), cross-shaped structures (cf. H.-T. Cen et al, previously cited), or any other conducting structures that are substantially electrically polarized in response to an applied electric field. In various embodiments, a complementary E-type element may have a substantially isotropic magnetic response to in-plane magnetic fields, or a substantially anisotropic magnetic response to in-plane magnetic fields.

While an M-type element may have a substantial (out-of-plane) magnetic response, in some approaches an M-type element may additionally have an (in-plane) electric response that is also substantial but of lesser magnitude than (e.g. having a smaller susceptibility than) the magnetic response. In these approaches, the corresponding complementary M-type element will have a substantial (out-of-plane) electric response, and additionally an (in-plane) magnetic response that is also substantial but of lesser magnitude than (e.g. having a smaller susceptibility than) the electric response. Similarly, while an E-type element may have a substantial (in-plane) electric response, in some approaches an E-type element may additionally have an (out-of-plane) magnetic response that is also substantial but of lesser magnitude than (e.g. having a smaller susceptibility than) the electric response. In these approaches, the corresponding complementary E-type element will have a substantial (in-plane) magnetic response, and additionally an (out-of-plane) electric response that is also substantial but of lesser magnitude than (e.g. having a smaller susceptibility than) the magnetic response.

Some embodiments provide a waveguide structure having one or more bounding conducting surfaces that embed complementary elements such as those described previously. In a waveguide context, quantitative assignment of quantities typically associated with volumetric materials—such as the electric permittivity, magnetic permeability, refractive index, and wave impedance—may be defined for planar waveguides and microstrip lines patterned with the complementary structures. For example, one or more complementary M-type elements such as CSRRs, patterned in one or more bounding surfaces of a waveguide structure, may be characterized as having an effective electric permittivity. Of note, the effective permittivity can exhibit both large positive and negative values, as well as values between zero and unity, inclusive. Devices can be developed based at least partially on the range of properties exhibited by the M-type elements, as will be described. The numerical and experimental techniques to quantitatively make this assignment are well-characterized.

Alternatively or additionally, in some embodiments complementary E-type elements such as CELCs, patterned into a waveguide structure in the same manner as described above, have a magnetic response that may be characterized as an effective magnetic permeability. The complementary E-type elements thus can exhibit both large positive and negative values of the effective permeability, as well as effective permeabilities that vary between zero and unity, inclusive (throughout this disclosure, real parts are generally referred to in the descriptions of the permittivity and permeability for both the complementary E-type and complementary M-type structures, except where context dictates otherwise as shall be apparent to one of skill in the art) Because both types of resonators can be implemented in the waveguide context, virtually any effective material condition can be achieved, including negative refractive index (both permittivity and permeability less than zero), allowing considerable control over waves propagating through these structures. For example, some embodiments may provide effective constitutive parameters substantially corresponding to a transformation optical medium (as according to the method of transformation optics, e.g. as described in J. Pendry et al, "Electromagnetic cloaking method," U.S. patent application Ser. No. 11/459,728).

Using a variety of combinations of the complementary E- and/or M-type elements, a wide variety of devices can be formed. For example, virtually all of the devices that have been demonstrated by Caloz and Itoh using CRLH TLs have analogs in the waveguiding metamaterial structures described here. Most recently, Silvereinha and Engheta proposed an interesting coupler based on creating a region in which the effective refractive index (or propagation constant) is nearly zero (CITE). The equivalent of such a medium can be created by the patterning of complementary E- and/or M-type elements into the bounding surfaces of a waveguide structure. The Figures show and describe exemplary illustrative non-limiting realizations of the zero index coupler and other devices with the use of patterned waveguides and several depictions as to how exemplary non-limiting structures may be implemented.

FIG. 1 shows an exemplary illustrative non-limiting wave-guided complementary ELC (magnetic response) structure, and FIGS. 1A-1D show associated exemplary plots of the effective index, wave impedance, permittivity and permeability. While the depicted example shows only a single CELC element, other approaches provide a plurality of CELC (or other complementary E-type) elements disposed on one or more surfaces of a waveguide structure.

Figure 2:
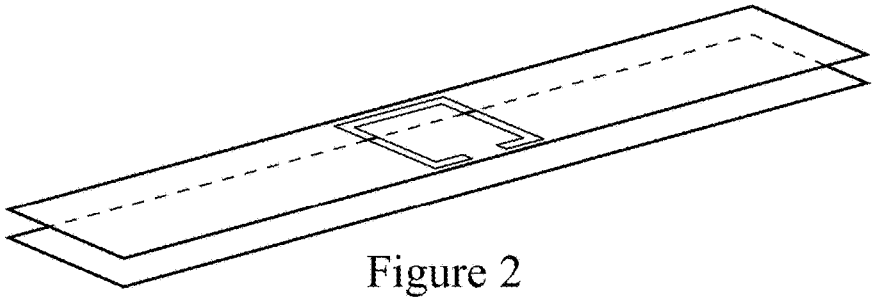
FIGS. 2-2D depict a wave-guided complementary SRR (electric response) structure (FIG. 2) and associated plots of effective permittivity, permeability, wave impedance, and refractive index (FIGS. 2A-2D)
Figure 2A:
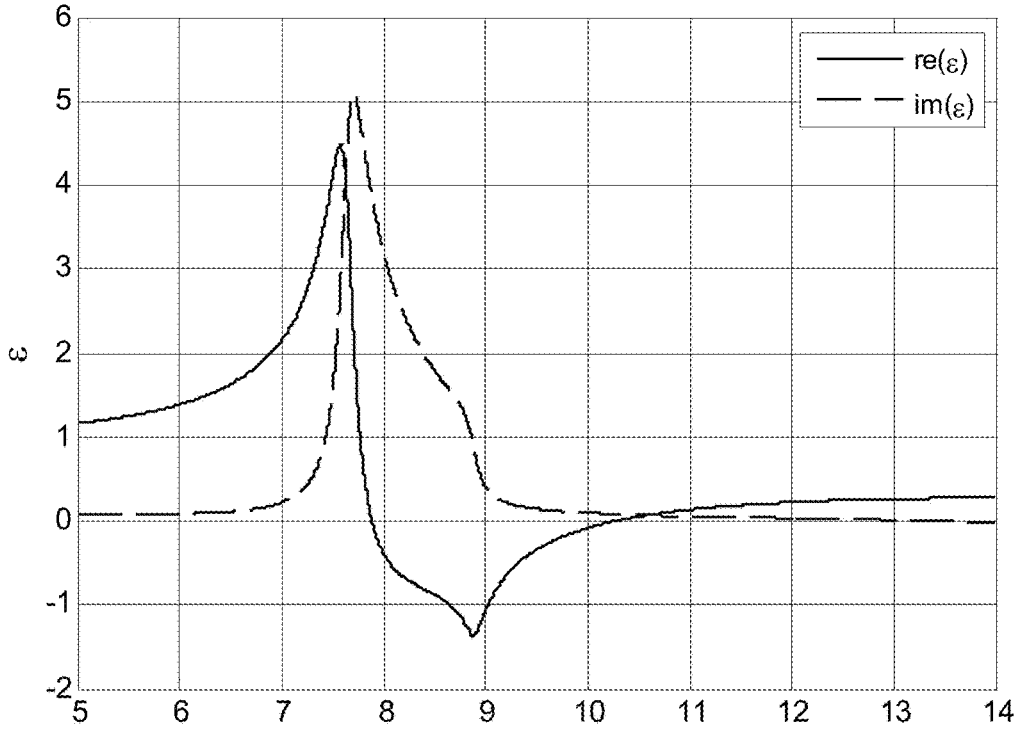
Figure 2B:
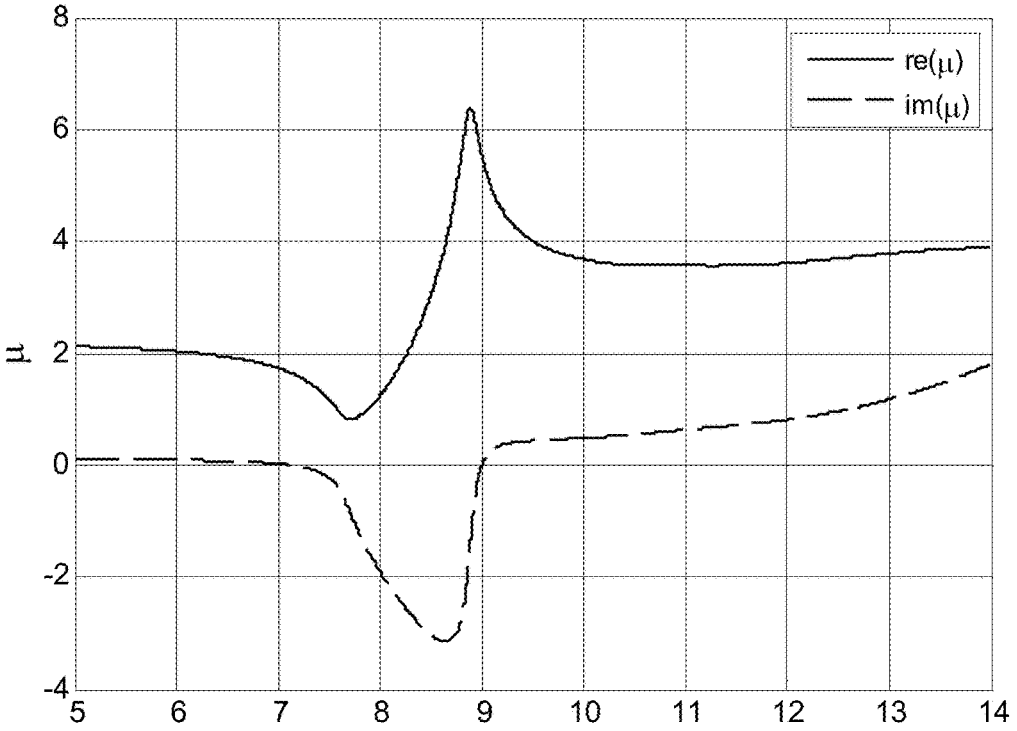
Figure 2C:
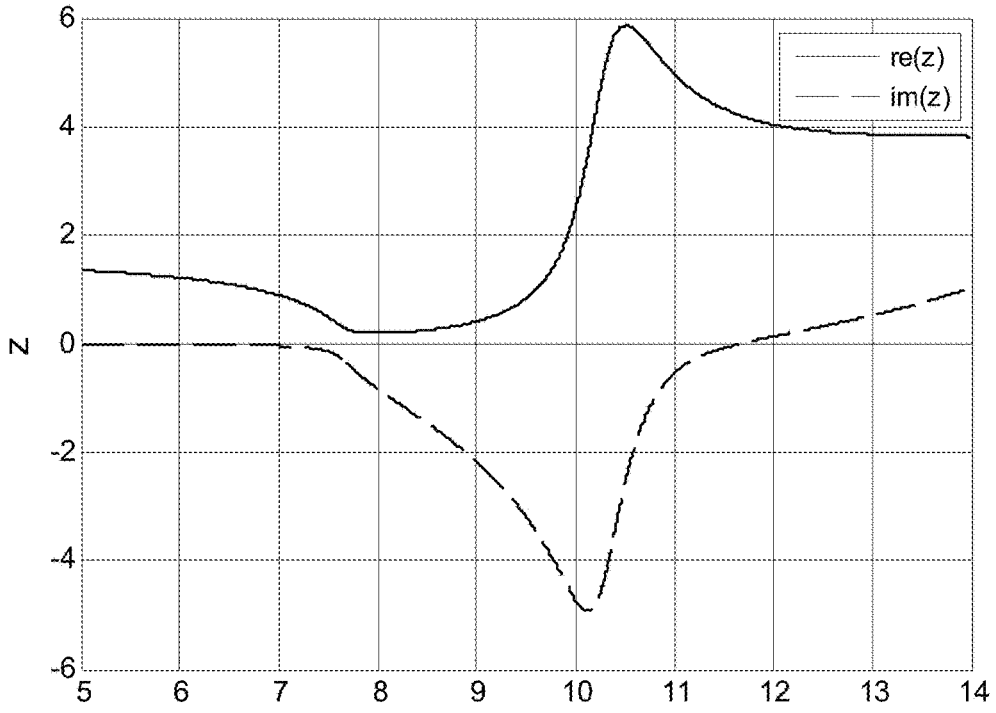
Figure 2D:
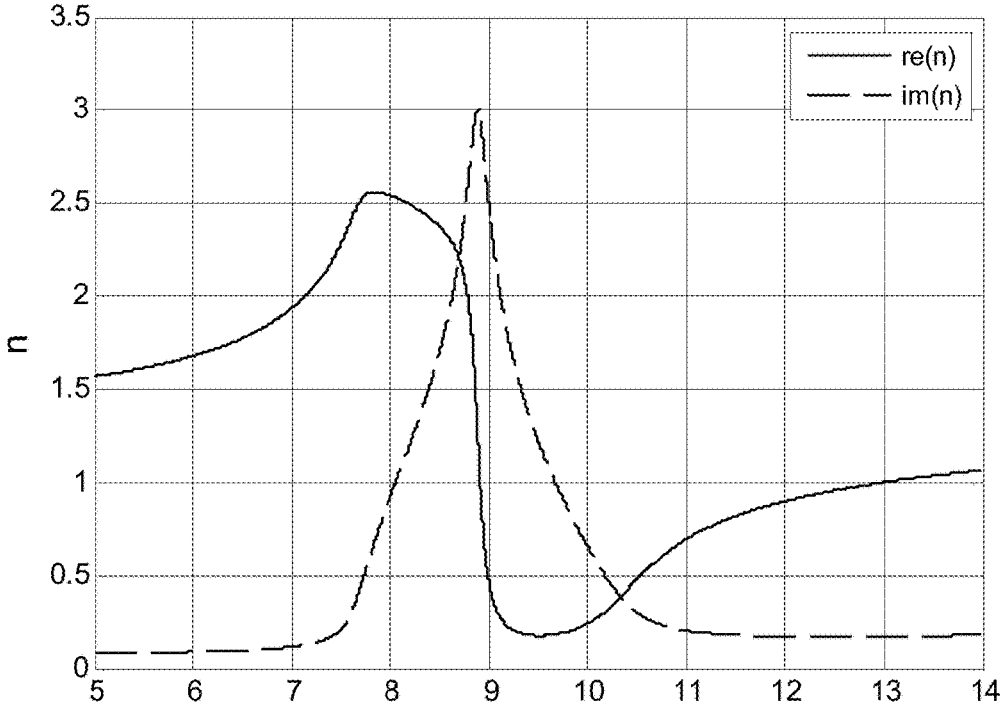

FIG. 2 shows an exemplary illustrative non-limiting wave-guided complementary SRR (electric response) structure, and FIGS. 2A-2D show associated exemplary plots of the effective index, wave impedance, permittivity and permeability. While the depicted example shows only a single CSRR element, other approaches provide a plurality of CSRR elements (or other complementary M-type) elements disposed on one or more surfaces of a waveguide structure.

Figure 3:
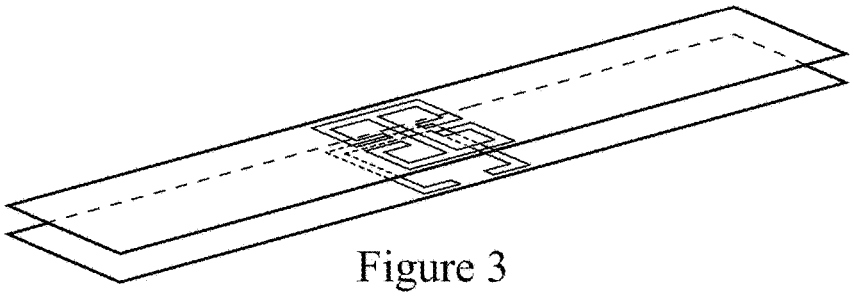
FIGS. 3-3D depict a wave-guided structure with both CSRR and CELC elements (e.g. to provide an effective negative index) (FIG. 3) and associated plots of effective permittivity, permeability, wave impedance, and refractive index (FIGS. 3A-3D)
Figure 3A:
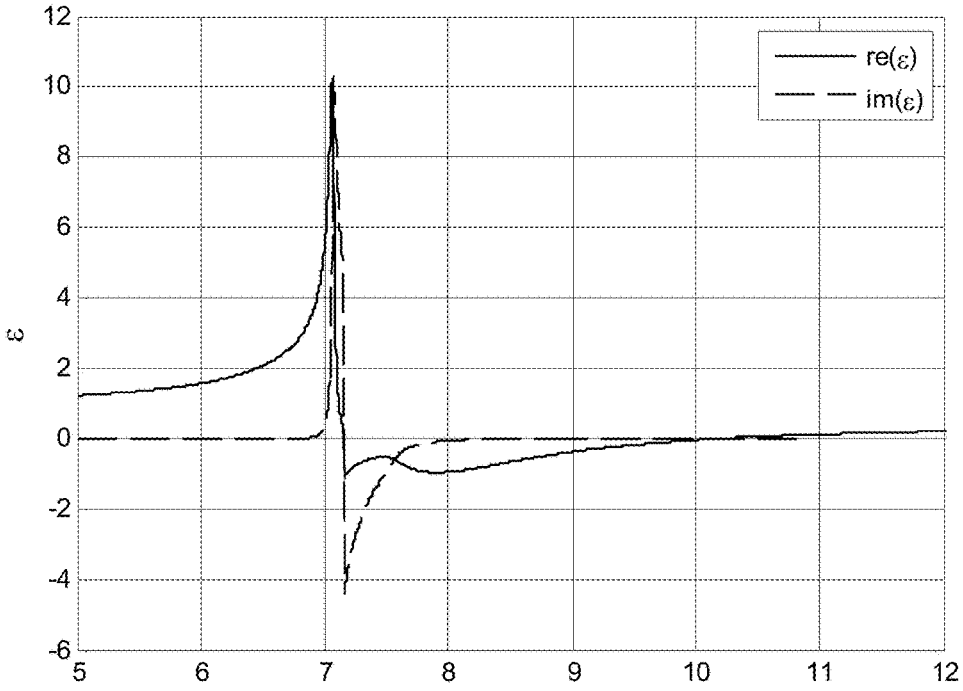
Figure 3B:
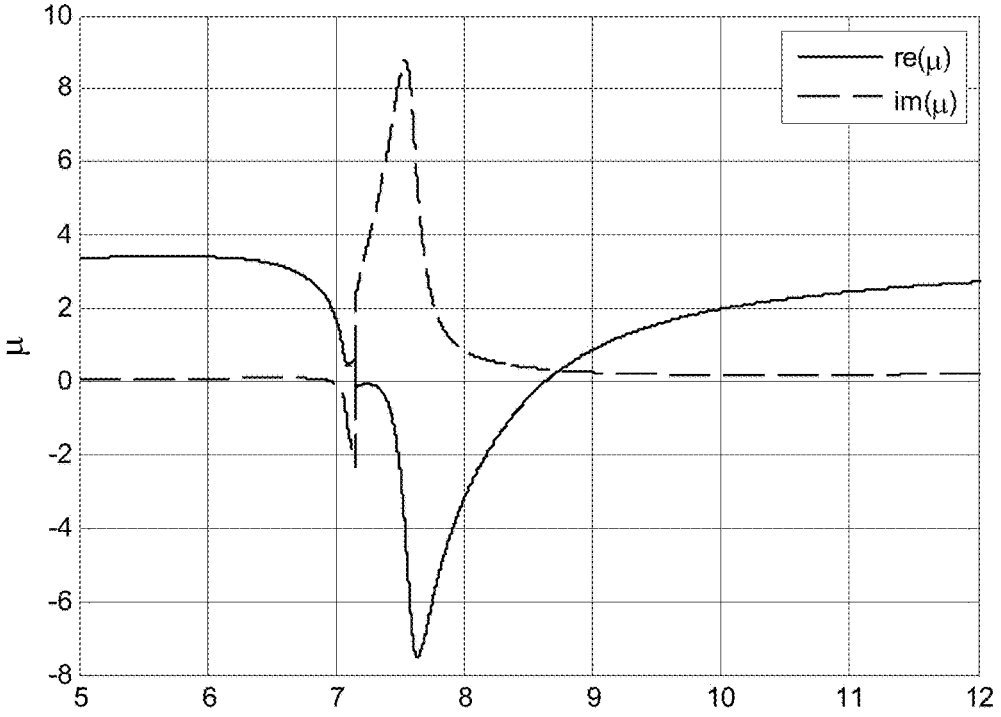
Figure 3C:
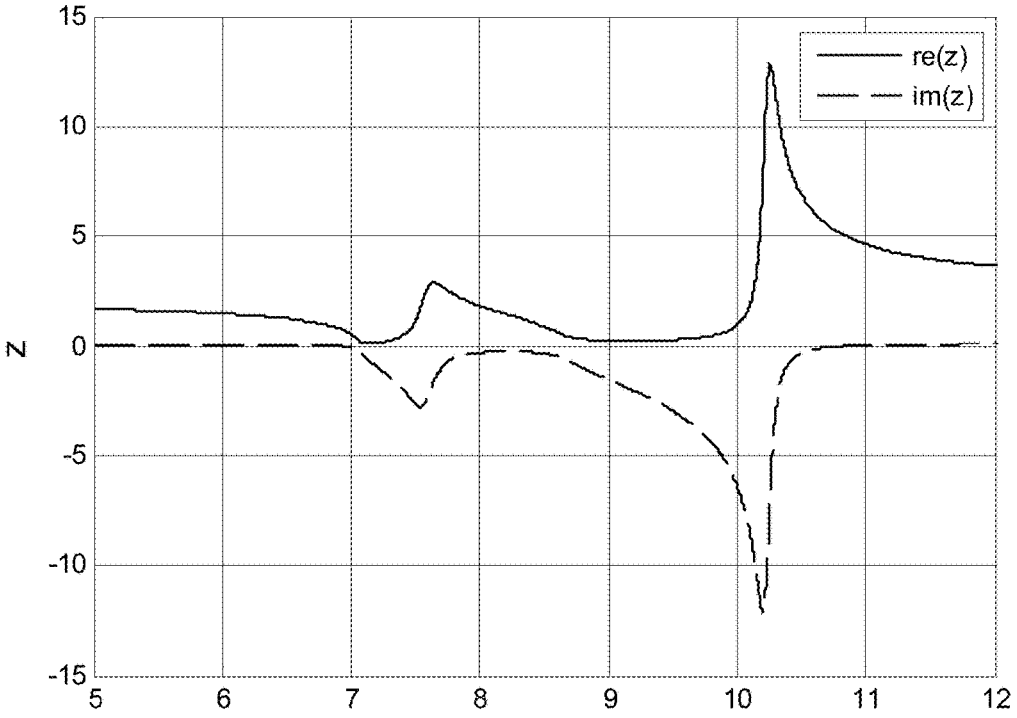
Figure 3D:
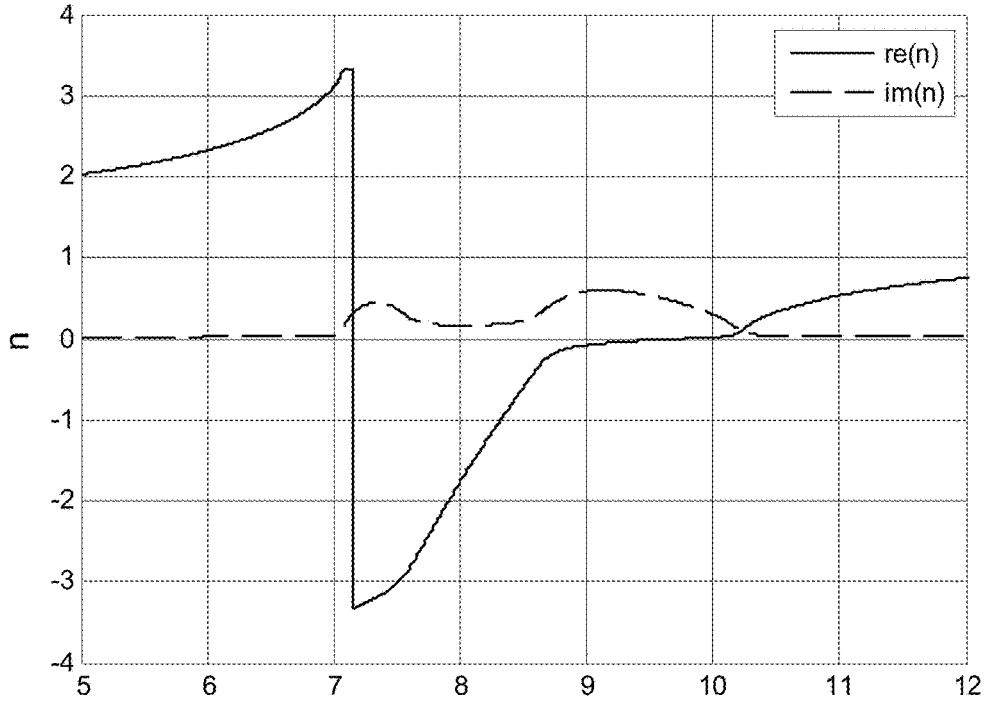

FIG. 3 shows an exemplary illustrative non-limiting wave-guided structure with both CSRR and CELC elements (e.g. to provide an effective negative index) in which the CSRR and CELC are patterned on opposite surfaces of a planar waveguide, and FIGS. 3A-3D show associated exemplary plots of the effective index, wave impedance, permittivity and permeability. While the depicted example shows only a single CELC element on a first bounding surface of a waveguide and a single CSRR element on a second bounding surface of the waveguide, other approaches provide a plurality of complementary E- and/or M-type elements disposed on one or more surfaces of a waveguide structure.

Figure 4:
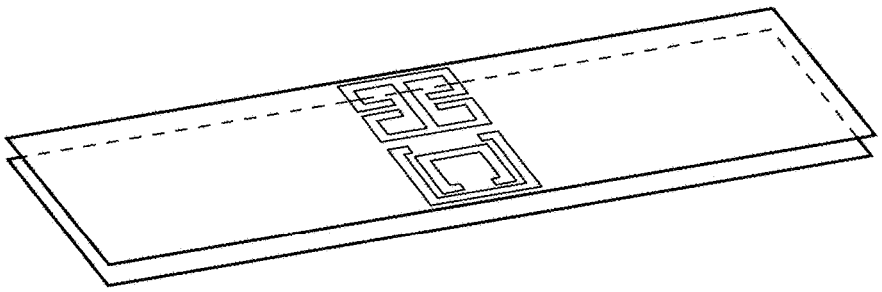
FIGS. 4-4D depict a wave-guided structure with both CSRR and CELC elements (e.g. to provide an effective negative index) (FIG. 4) and associated plots of effective permittivity, permeability, wave impedance, and refractive index (FIGS. 4A-4D)
Figure 4A:
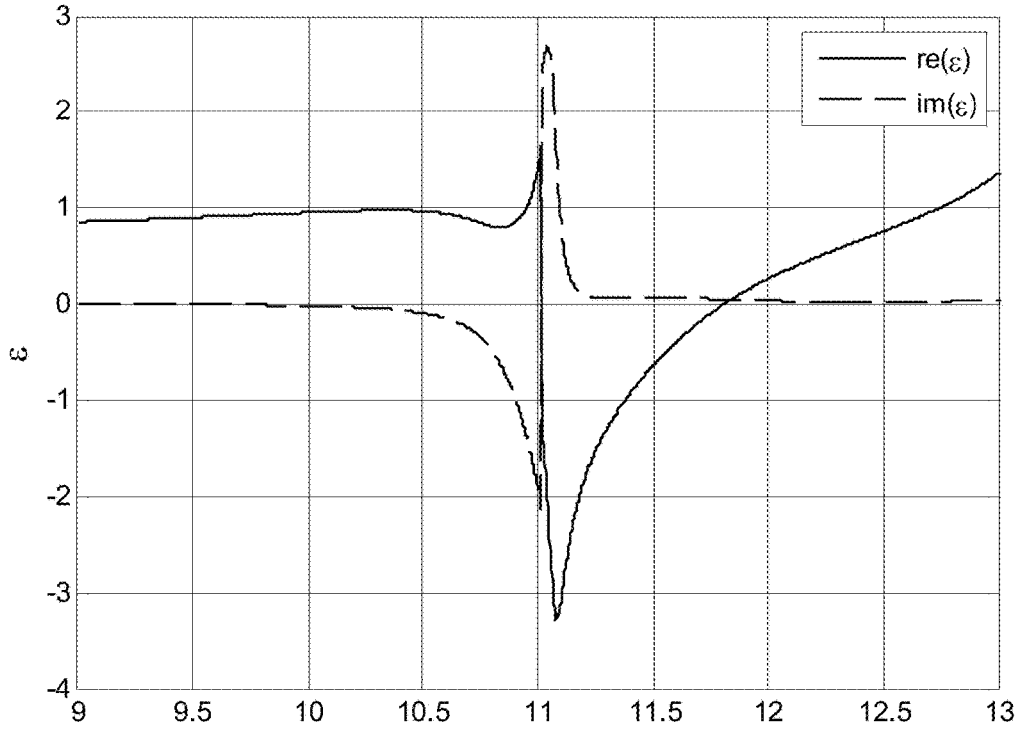
Figure 4B:
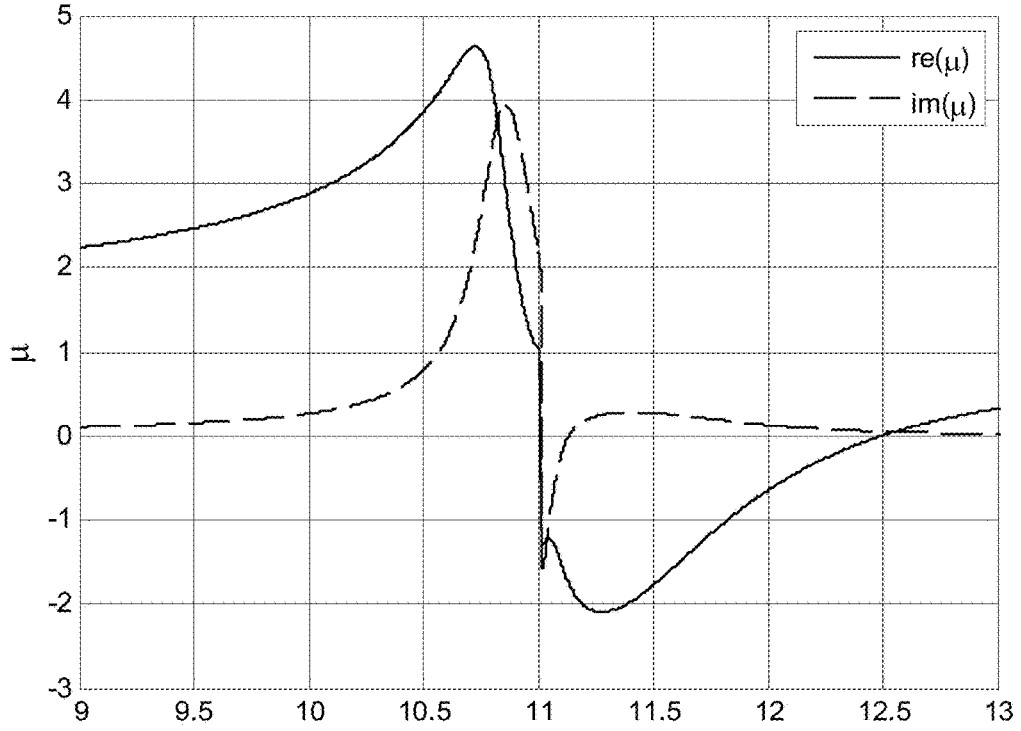
Figure 4C:
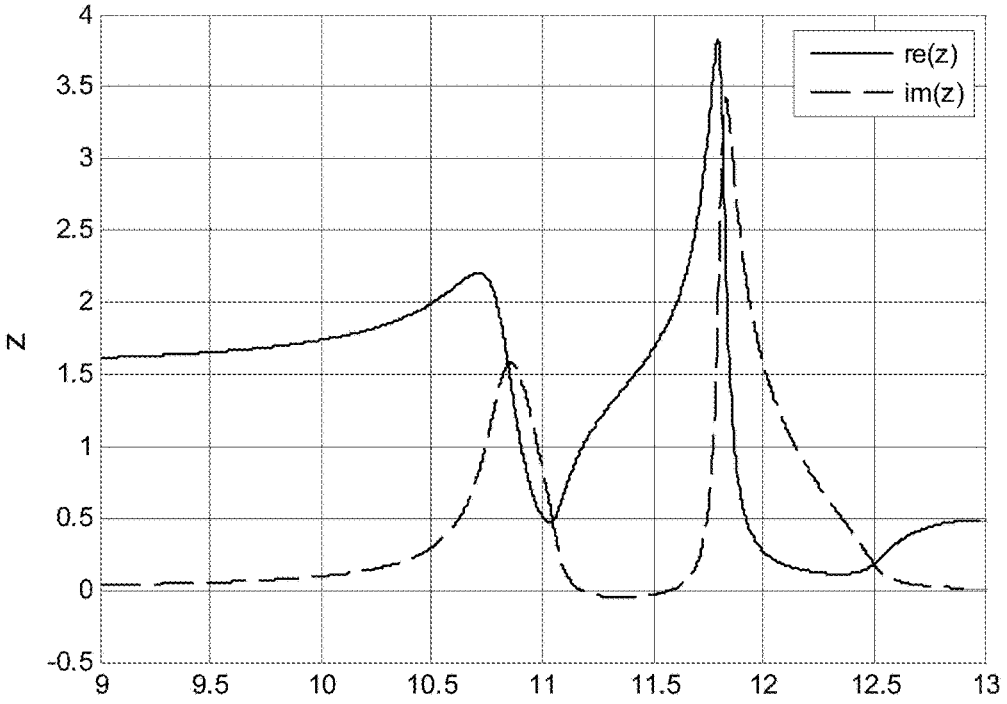
Figure 4D:
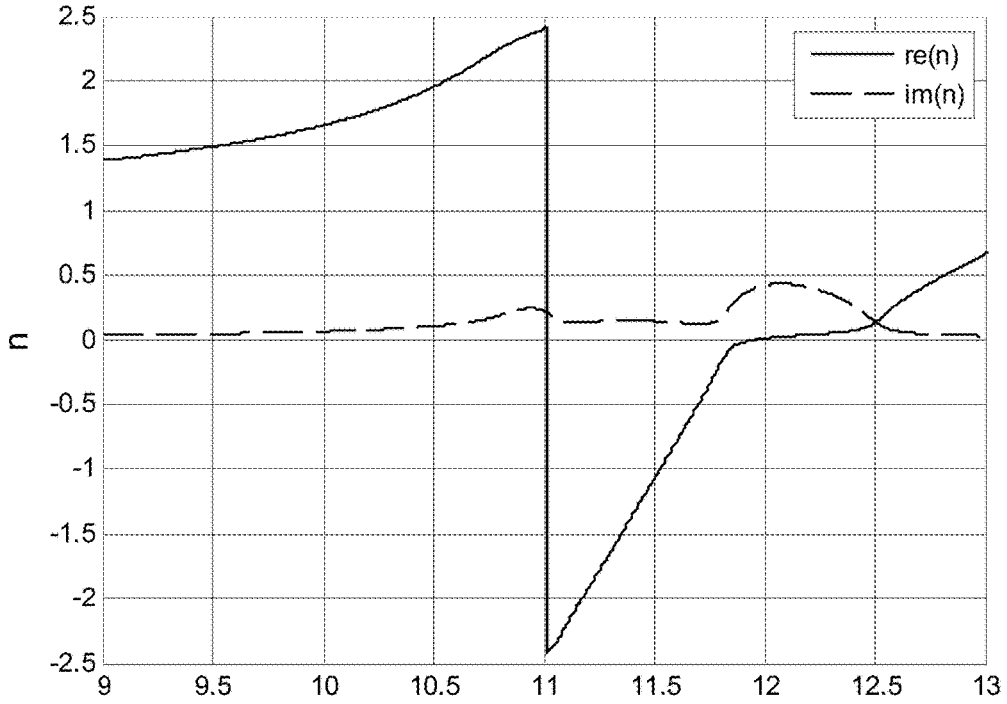

FIG. 4 shows an exemplary illustrative non-limiting wave-guided structure with both CSRR and CELC elements (e.g. to provide an effective negative index) in which the CSRR and CELC are patterned on the same surface of a planar waveguide, and FIGS. 4A-4D show associated exemplary plots of the effective index, wave impedance, permittivity and permeability. While the depicted example shows only a single CELC element and a single CSRR element on a first bounding surface of a waveguide, other approaches provide a plurality of complementary E- and/or M-type elements disposed on one or more surfaces of a waveguide structure.

Figure 5:
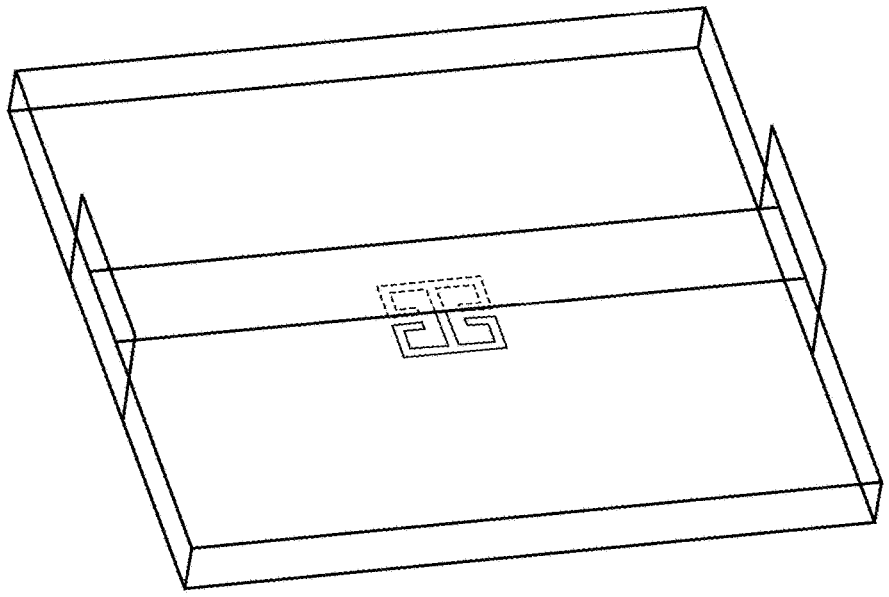
FIGS. 5-5D depict a microstrip complementary ELC structure (FIG. 5) and associated plots of effective permittivity, permeability, wave impedance, and refractive index (FIGS. 5A-5D)
Figure 5A:
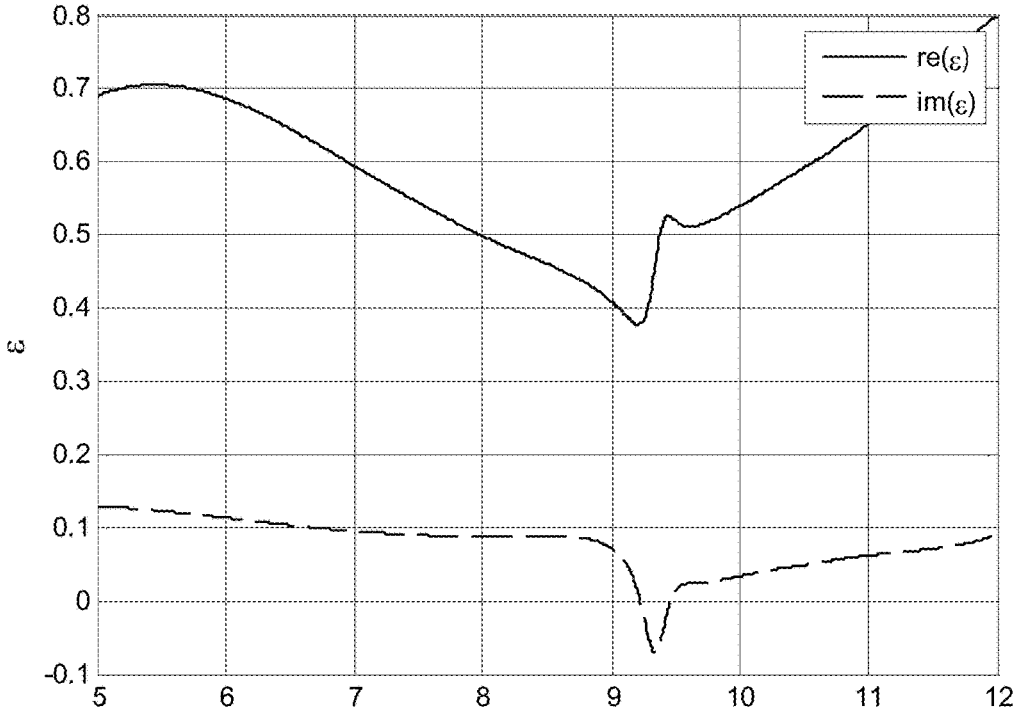
Figure 5B:
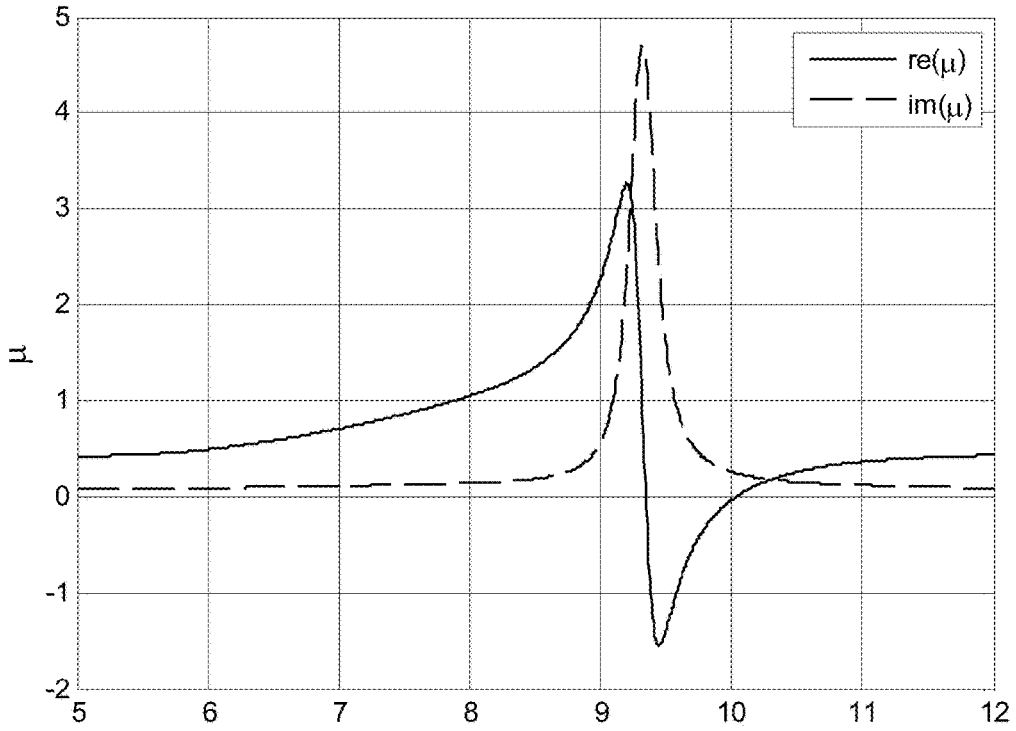
Figure 5C:
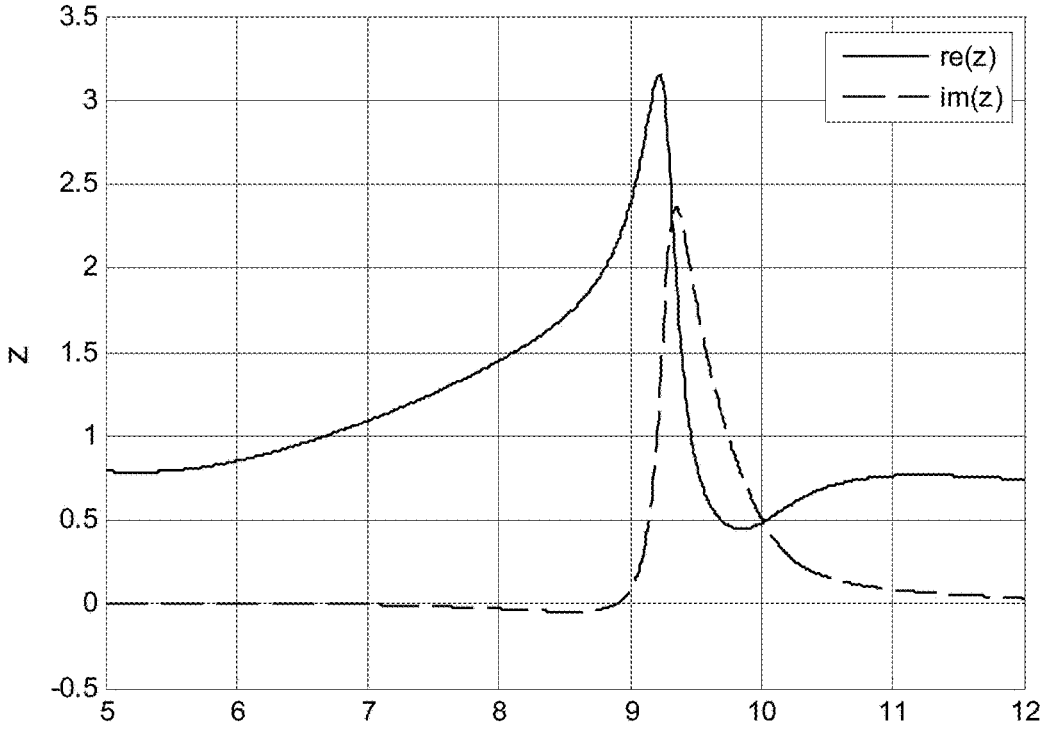
Figure 5D:
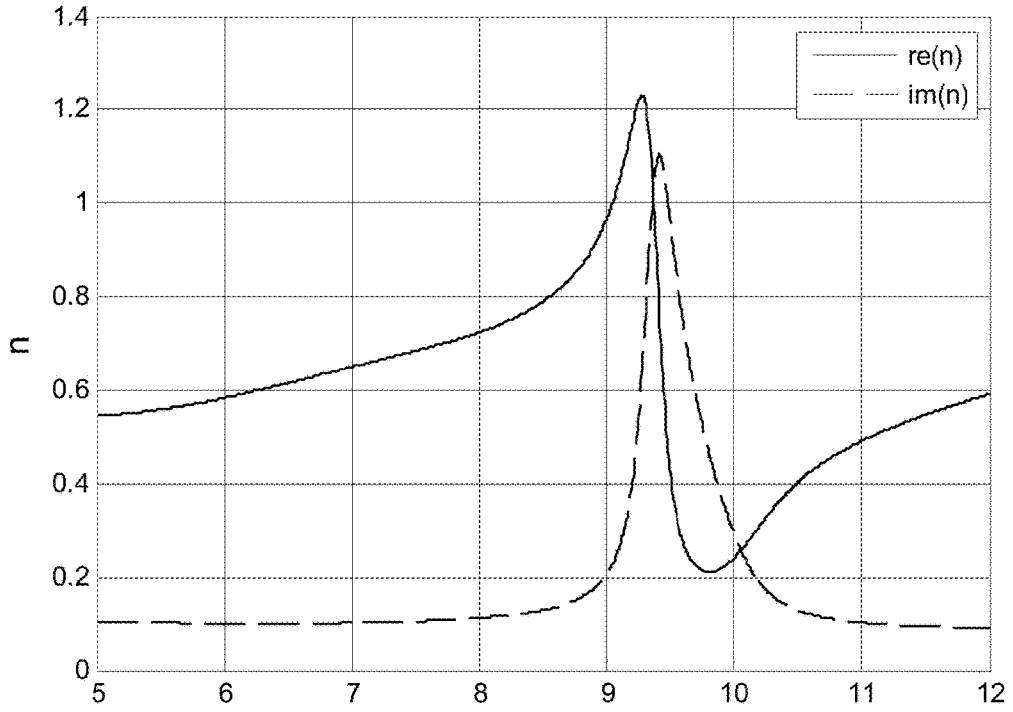

FIG. 5 shows an exemplary illustrative non-limiting microstrip complementary ELC structure, and FIGS. 5A-5D show associated exemplary plots of the effective index, wave impedance, permittivity and permeability. While the depicted example shows only a single CELC element on the ground plane of a microstrip structure, other approaches provide a plurality of CELC (or other complementary E-type) elements disposed on one or both of the strip portion of the microstrip structure or the ground plane portion of the microstrip structure.

Figure 6:
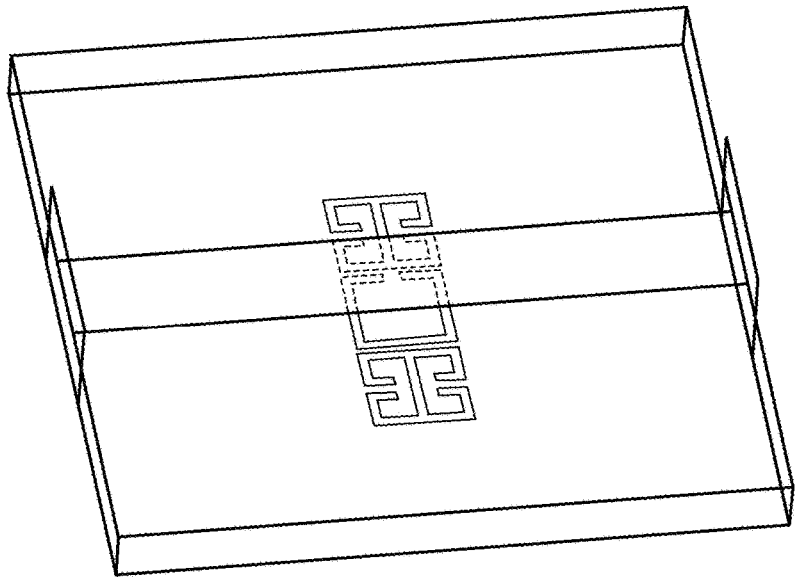
FIGS. 6-6D are depict a microstrip structure with both CSRR and CELC elements (e.g. to provide an effective negative index) (FIG. 6) and associated plots of effective permittivity, permeability, wave impedance, and refractive index (FIGS. 6A-6D)
Figure 6A:
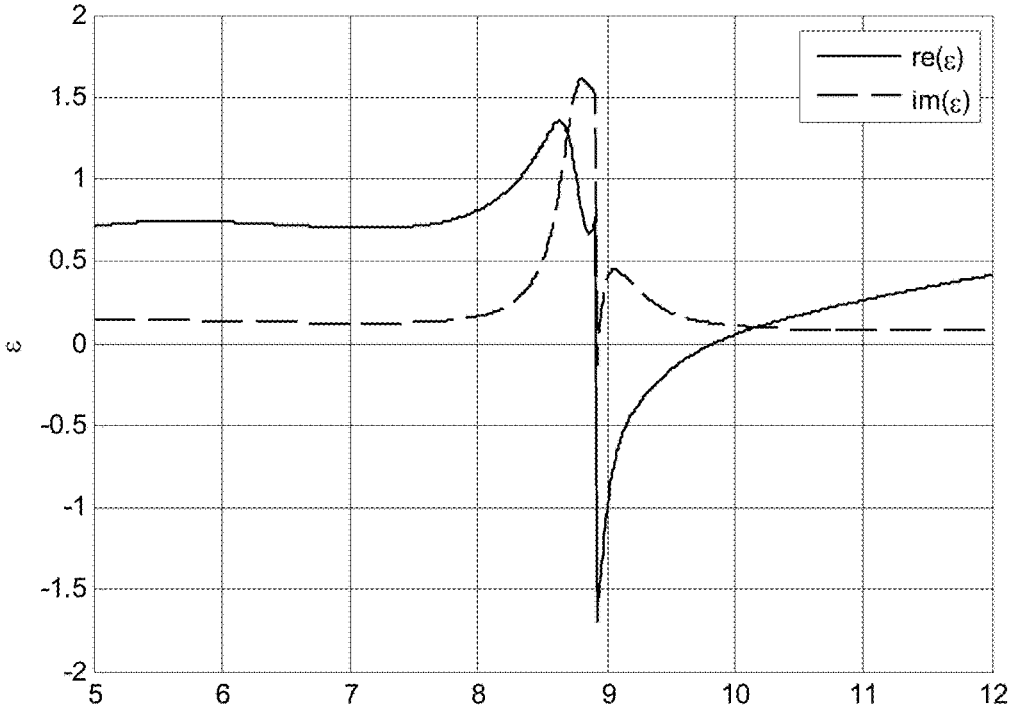
Figure 6B:
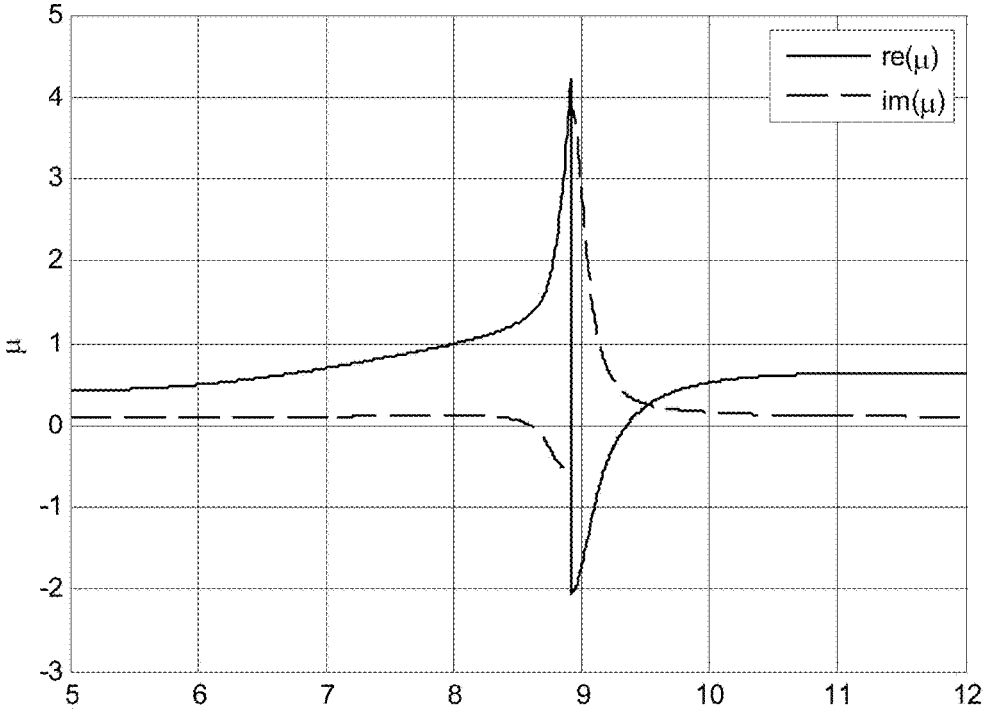
Figure 6C:
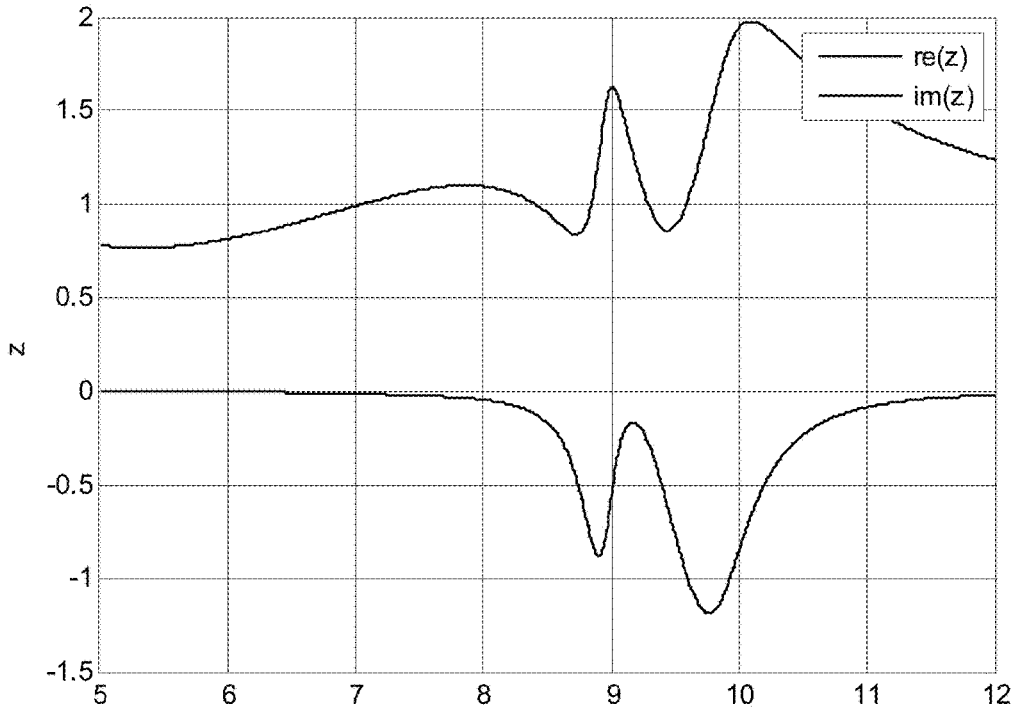
Figure 6D:
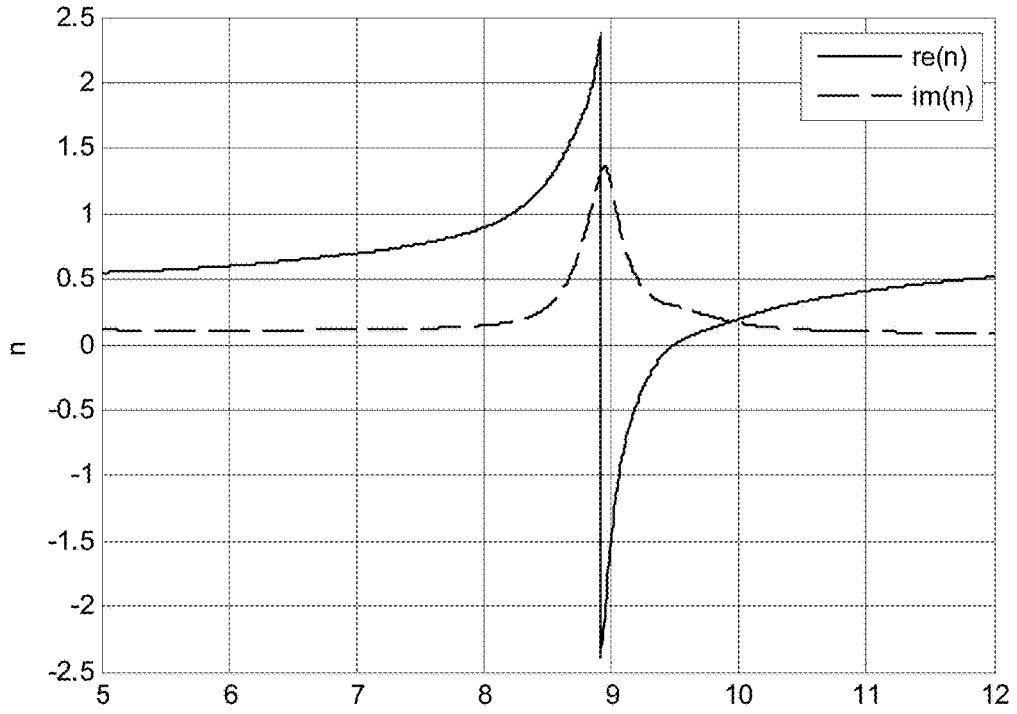

FIG. 6 shows an exemplary illustrative non-limiting micro-strip line structure with both CSRR and CELC elements (e.g. to provide an effective negative index), and FIGS. 6A-6D show associated exemplary plots of the effective index, wave impedance, permittivity and permeability. While the depicted example shows only a single CSRR element and two CELC elements on the ground plane of a microstrip structure, other approaches provide a plurality of complementary E- and/or M-type elements disposed on one or both of the strip portion of the microstrip structure or the ground plane portion of the microstrip structure.

Figure 7:
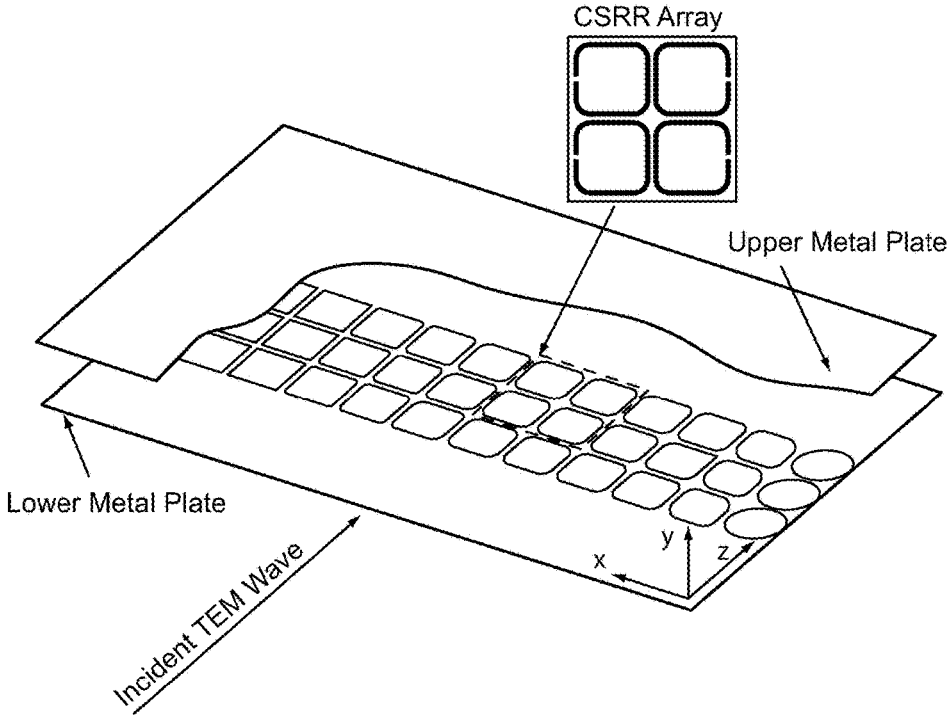
FIG. 7 depicts an exemplary CSRR array as a 2D planar waveguide structure.

FIG. 7 illustrates the use of a CSRR array as a 2D waveguide structure. In some approaches a 2D waveguide structure may have bounding surfaces (e.g. the upper and lower metal places depicted in FIG. 7) that are patterned with complementary E- and/or M-type elements to implement functionality such as impedance matching, gradient engineering, or dispersion control.

Figures 1, 8:
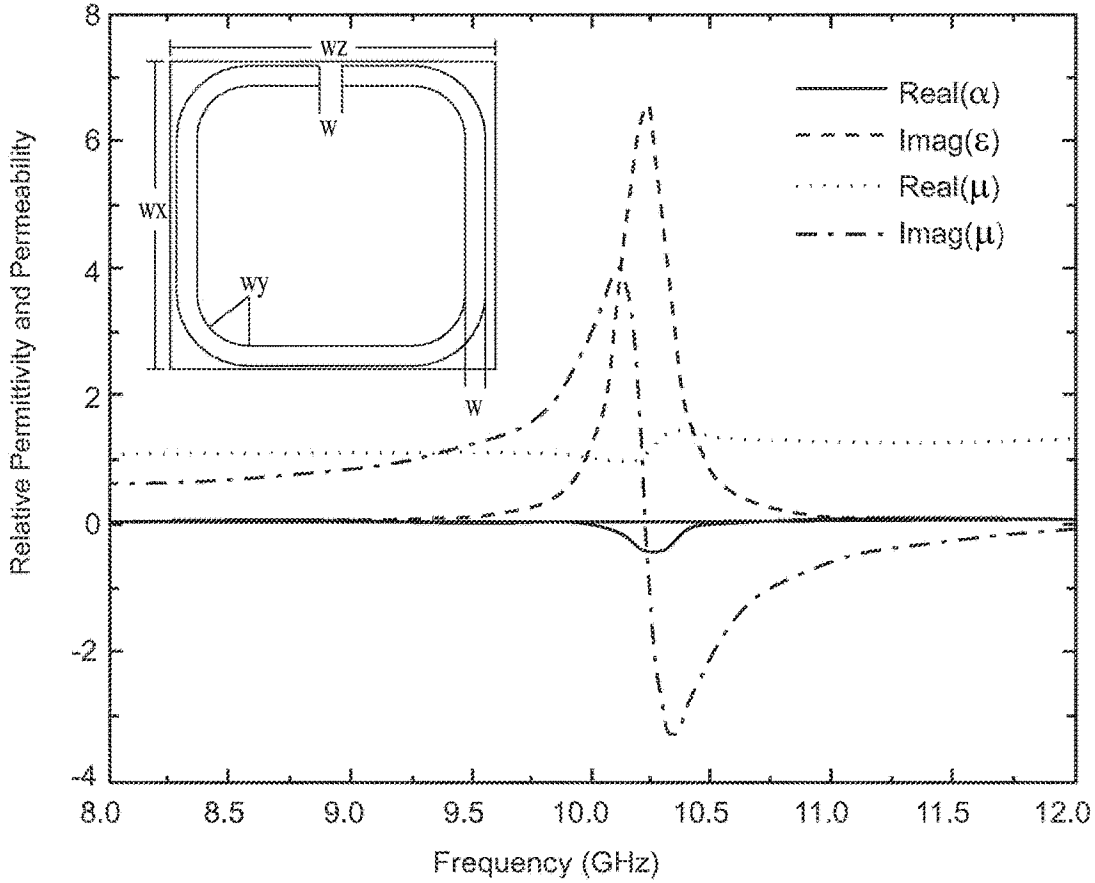
Figures 2, 8:
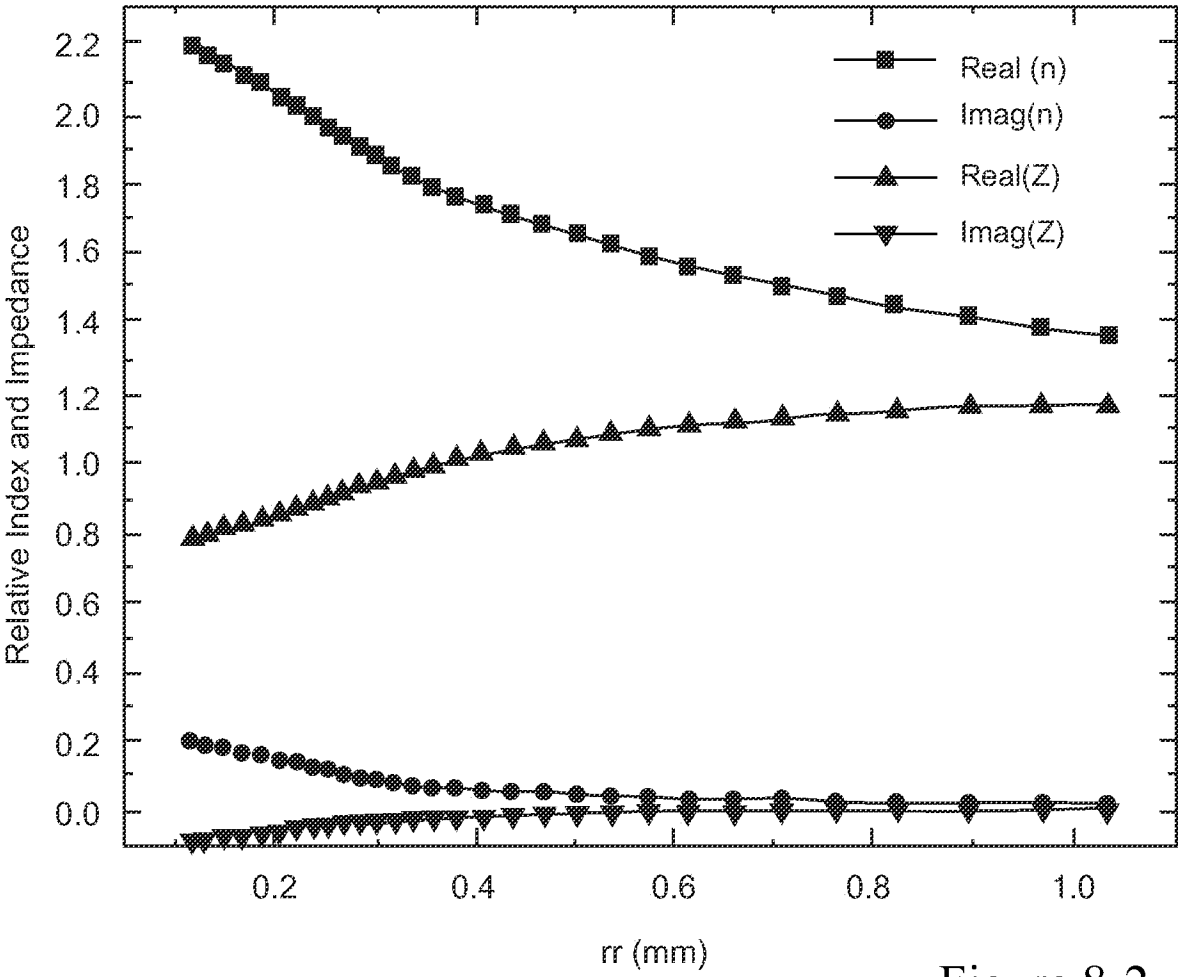

As an example of gradient engineering, the CSRR structure of FIG. 7 has been utilized to form both gradient index beam-steering and beam-focusing structures. FIG. 8-1 illustrates a single exemplary CSRR and the retrieved permittivity and permeability corresponding to the CSRR (in the waveguide geometry). By changing parameters within the CSRR design (in this case a curvature of each bend of the CSRR), the index and/or the impedance can be tuned, as shown in FIG. 8-2.

Figures 1, 9:
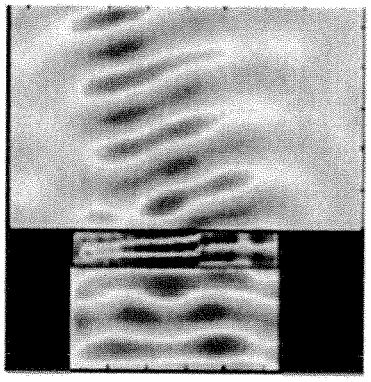
Figures 2, 9:
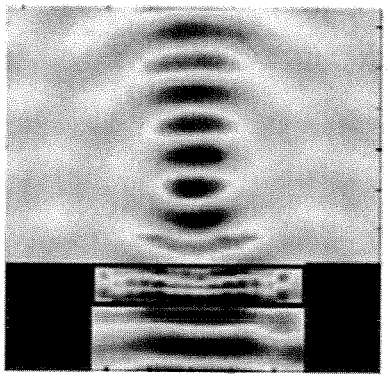
Figures 1, 10:
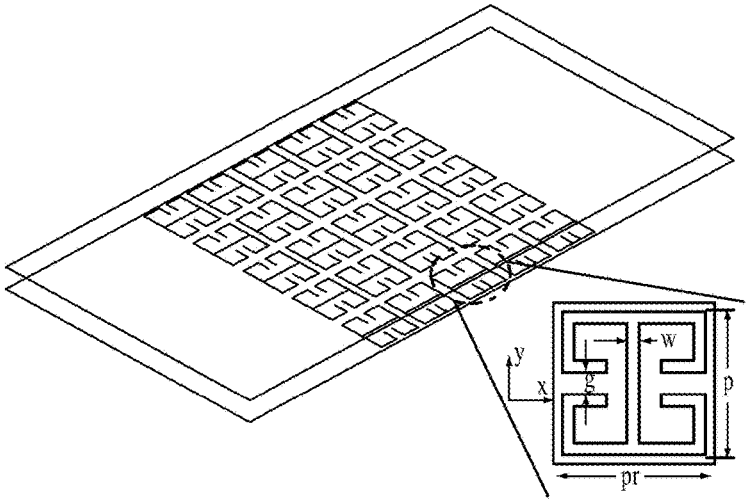
Figures 2, 10:
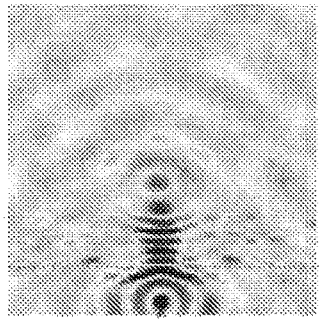

A CSRR structure laid out as shown in FIG. 7, with a substantially linear gradient of refractive index imposed along the direction transverse to the incident guided beam, produces an exit beam that is steered to an angle different from that of the incident beam. FIG. 9-1 shows exemplary field data taken on a 2D implementation of the planar waveguide beam-steering structure. The field mapping apparatus has been described in considerable detail in the literature [B. J. Justice, J. J. Mock, L. Guo, A. Degiron, D. Schurig, D. R. Smith, "Spatial mapping of the internal and external electromagnetic fields of negative index metamaterials," Optics Express, vol. 14, p. 8694 (2006)]. Likewise, implementing a parabolic refractive index gradient along the direction transverse to the incident beam within the CSRR array produces a focusing lens, e.g. as shown in FIG. 9-2. More generally, a transverse index profile that is a concave function (parabolic or otherwise) will provide a positive focusing effect, such as depicted in FIG. 9-2 (corresponding to a positive focal length); a transverse index profile that is a convex function (parabolic or otherwise) will provide a negative focusing effect (corresponding to a negative focal length, e.g. to receive a collimated beam and transmit a diverging beam). For approaches wherein the metamaterial elements include adjustable metamaterial elements (as discussed below), embodiments may provide an apparatus having an electromagnetic function (e.g. beam steering, beam focusing, etc.) that is correspondingly adjustable. Thus, for example, a beam steering apparatus may be adjusted to provide at least first and second deflection angles; a beam focusing apparatus may be adjusted to provide at least first and second focal lengths, etc. An example of a 2D medium formed with CELCs is shown in FIGS. 10-1, 10-2. Here, an in-plane anisotropy of the CELCs is used to form an 'indefinite medium,' in which a first in-plane component of the permeability is negative while another in-plane component is positive. Such a medium produces a partial refocusing of waves from a line source, as shown in the experimentally obtained field map of FIG. 10-2. The focusing properties of a bulk indefinite medium have previously been reported [D. R. Smith, D. Schurig, J. J. Mock, P. Kolinko, P. Rye, "Partial focusing of radiation by a slab of indefinite media," Applied Physics Letters, vol. 84, p. 2244 (2004)]. The experiments shown in this set of figures validate the design approach, and show that waveguide metamaterial elements can be produced with sophisticated functionality, including anisotropy and gradients.

Figures 1, 11:
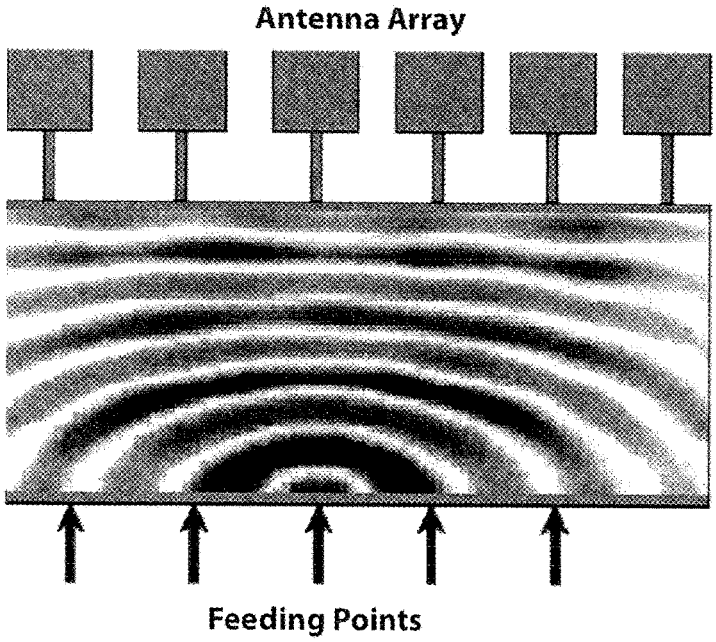
Figures 2, 11:
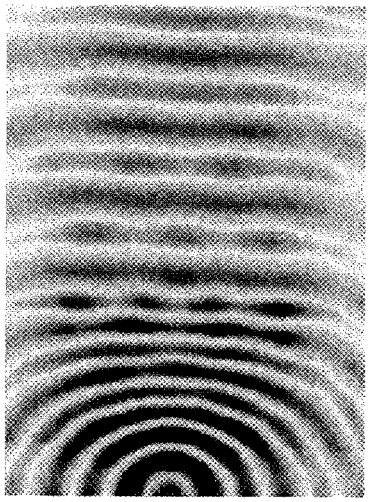

In FIGS. 11-1 and 11-2, a waveguide-based gradient index structure (e.g. having boundary conductors that include complementary E- and/or M-type elements, as in FIGS. 7 and 10-1) is disposed as a feed structure for an array of patch antennas. In the exemplary embodiment of FIGS. 11-1 and 11-2, the feed structure collimates waves from a single source that then drive an array of patch antennas. This type of antenna configuration is well known as the Rotman lens configuration. In this exemplary embodiment, the waveguide metamaterial provides an effective gradient index lens within a planar waveguide, by which a plane wave can be generated by a point source positioned on the focal plane of the gradient index lens, as illustrated by the "feeding points" in FIG. 11-2. For the Rotman Lens antenna, one can place multiple feeding points on the focal plane of the gradient index metamaterial lens and connect antenna elements to the output of the waveguide structure as shown in FIG. 11-1. From well known optics theory, the phase difference between each antenna will depend on the feed position of the source, so that phased-array beam forming can be implemented. FIG. 11-2 is a field map, showing the fields from a line source driving the gradient index planar waveguide metamaterial at the focus, resulting in a collimated beam. While the exemplary feed structure of FIGS. 11-1 and 11-2 depicts a Rotman-lens type configuration for which the antenna phase differences are substantially determined by the location of the feeding point, in other approaches the antenna phase differences are determined by fixing the feeding point and adjusting the electromagnetic properties (and therefore the phase propagation characteristics of) the gradient index lens (e.g. by deploying adjustable metamaterial elements, as discussed below), while other embodiments may combine both approaches (i.e. adjustment of both the feeding point position and the lens parameters to cumulatively achieve the desired antenna phase differences).

In some approaches, a waveguide structure having an input port or input region for receiving electromagnetic energy may include an impedance matching layer (IML) positioned at the input port or input region, e.g. to improve the input insertion loss by reducing or substantially eliminating reflections at the input port or input region. Alternatively or additionally, in some approaches a waveguide structure having an output port or output region for transmitting electromagnetic energy may include an impedance matching layer (IML) positioned at the output port or output region, e.g. to improve the output insertion loss by reducing or substantially eliminating reflections at the output port or output region. An impedance matching layer may have a wave impedance profile that provides a substantially continuous variation of wave impedance, from an initial wave impedance at an external surface of the waveguide structure (e.g. where the waveguide structure abuts an adjacent medium or device) to a final wave impedance at an interface between the IML and a gradient index region (e.g. that provides a device function such as beam steering or beam focusing). In some approaches the substantially continuous variation of wave impedance corresponds to a substantially continuous variation of refractive index (e.g. where turning an arrangement of one species of element adjusts both an effective refractive and an effective wave impedance according to a fixed correspondence, such as depicted in FIG. 8-2), while in other approaches the wave impedance may be varied substantially independently of the refractive index (e.g. by deploying both complementary E- and M-type elements and independently turning the arrangements of the two species of elements to correspondingly independently tune the effective refractive index and the effective wave impedance).

While exemplary embodiments provide spatial arrangements of complementary metamaterial elements having varied geometrical parameters (such as a length, thickness, curvature radius, or unit cell dimension) and correspondingly varied individual electromagnetic responses (e.g. as depicted in FIG. 8-2), in other embodiments other physical parameters of the complementary metamaterial elements are varied (alternatively or additionally to varying the geometrical parameters) to provide the varied individual electromagnetic responses. For example, embodiments may include complementary metamaterial elements (such as CSRRs or CELCs) that are the complements of original metamaterial elements that include capacitive gaps, and the complementary metamaterial elements may be parameterized by varied capacitances of the capacitive gaps of the original metamaterial elements. Equivalently, noting that from Babinet's theorem a capacitance in an element (e.g. in the form of a planar interdigitated capacitor having a varied number of digits and/or varied digit length) becomes an inductance in the complement thereof (e.g. in the form of a meander line inductor having a varied number of turns and/or varied turn length), the complementary elements may be parameterized by varied inductances of the complementary metamaterial elements. Alternatively or additionally, embodiments may include complementary metamaterial elements (such as CSRRs or CELCs) that are the complements of original metamaterial elements that include inductive circuits, and the complementary metamaterial elements may be parameterized by varied inductances of the inductive circuits of the original metamaterial elements. Equivalently, noting that from Babinet's theorem an inductance in an element (e.g. in the form of a meander line inductor having a varied number of turns and/or varied turn length) becomes a capacitance in the complement thereof (e.g. in the form of an planar interdigitated capacitor having a varied number of digits and/or varied digit length), the complementary elements may be parameterized by varied capacitances of the complementary metamaterial elements. Moreover, a substantially planar metamaterial element may have its capacitance and/or inductance augmented by the attachment of a lumped capacitor or inductor. In some approaches, the varied physical parameters (such as geometrical parameters, capacitances, inductances) are determined according to a regression analysis relating electromagnetic responses to the varied physical parameters (c.f. the regression curves in FIG. 8-2)

In some embodiments the complementary metamaterial elements are adjustable elements, having adjustable physical parameters corresponding to adjustable individual electromagnetic responses of the elements. For example, embodiments may include complementary elements (such as CSRRs) having adjustable capacitances (e.g. by adding varactor diodes between the internal and external metallic regions of the CSRRs, as in A. Velez and J. Bonarche, "Varactor-loaded complementary split ring resonators (VLCSRR) and their application to tunable metamaterial transmission lines," IEEE Microw. Wireless Compon. Lett. 18, 28 (2008)). In another approach, for waveguide embodiments having an upper and a lower conductor (e.g. a strip and a ground plane) with an intervening dielectric substrate, complementary metamaterial elements embedded in the upper and/or lower conductor may be adjustable by providing a dielectric substrate having a nonlinear dielectric response (e.g. a ferroelectric material) and applying a bias voltage between the two conductors. In yet another approach, a photosensitive material (e.g. a semiconductor material such as GaAs or n-type silicon) may be positioned adjacent to a complementary metamaterial element, and the electromagnetic response of the element may be adjustable by selectively applying optical energy to the photosensitive material (e.g. to cause photodoping). In yet another approach, a magnetic layer (e.g. of a ferrimagnetic or ferromagnetic material) may be positioned adjacent to a complementary metamaterial element, and the electromagnetic response of the element may be adjustable by applying a bias magnetic field (e.g. as described in J. Gollub et al, "Hybrid resonant phenomenon in a metamaterial structure with integrated resonant magnetic material," arXiv: 0810.4871 (2008)). While exemplary embodiments herein may employ a regression analysis relating electromagnetic responses to geometrical parameters (cf. the regression curve in FIG. 8-2), embodiments with adjustable elements may employ a regression analysis relating electromagnetic responses to adjustable physical parameters that substantially correlate with the electromagnetic responses.

In some embodiments with adjustable elements having adjustable physical parameters, the adjustable physical parameters may be adjustable in response to one or more external inputs, such as voltage inputs (e.g. bias voltages for active elements), current inputs (e.g. direct injection of charge carriers into active elements), optical inputs (e.g. illumination of a photoactive material), or field inputs (e.g. bias electric/magnetic fields for approaches that include ferroelectrics/ferromagnets). Accordingly, some embodiments provide methods that include determining respective values of adjustable physical parameters (e.g. by a regression analysis), then providing one or more control inputs corresponding to the determined respective values. Other embodiments provide adaptive or adjustable systems that incorporate a control unit having circuitry configured to determine respective values of adjustable physical parameters (e.g. by a regression analysis) and/or provide one or more control inputs corresponding to determined respective values.

While some embodiments employ a regression analysis relating electromagnetic responses to physical parameters (including adjustable physical parameters), for embodiments wherein the respective adjustable physical parameters are determined by one or more control inputs, a regression analysis may directly relate the electromagnetic responses to the control inputs. For example, where the adjustable physical parameter is an adjustable capacitance of a varactor diode as determined from an applied bias voltage, a regression analysis may relate electromagnetic responses to the adjustable capacitance, or a regression analysis may relate electromagnetic responses to the applied bias voltage.

While some embodiments provide substantially narrow-band responses to electromagnetic radiation (e.g. for frequencies in a vicinity of one or more resonance frequencies of the complementary metamaterial elements), other embodiments provide substantially broad-band responses to electromagnetic radiation (e.g. for frequencies substantially less than, substantially greater than, or otherwise substantially different than one or more resonance frequencies of the complementary metamaterial elements). For example, embodiments may deploy the Babinet complements of broadband metamaterial elements such as those described in R. Liu et al, "Broadband gradient index optics based on non-resonant metamaterials," unpublished; see attached Appendix) and/or in R. Liu et al, "Broadband ground-plane cloak," Science 323, 366 (2009)).

While the preceding exemplary embodiments are planar embodiments that are substantially two-dimensional, other embodiments may deploy complementary metamaterial elements in substantially non-planar configurations, and/or in substantially three-dimensional configurations. For example, embodiments may provide a substantially three-dimensional stack of layers, each layer having a conducting surface with embedded complementary metamaterial elements. Alternatively or additionally, the complementary metamaterial elements may be embedded in conducting surfaces that are substantially non-planar (e.g. cylinders, spheres, etc.). For example, an apparatus may include a curved conducting surface (or a plurality thereof) that embeds complementary metamaterial elements, and the curved conducting surface may have a radius of curvature that is substantially larger than a typical length scale of the complementary metamaterial elements but comparable to or substantially smaller than a wavelength corresponding to an operating frequency of the apparatus.

While the technology herein has been described in connection with exemplary illustrative non-limiting implementations, the invention is not to be limited by the disclosure. The invention is intended to be defined by the claims and to cover all corresponding and equivalent arrangements whether or not specifically disclosed herein.

All documents and other information sources cited above are hereby incorporated in their entirety by reference.

APPENDIX

Utilizing non-resonant metamaterial elements, we demonstrate that complex gradient index optics can be constructed exhibiting low material losses and large frequency bandwidth. Although the range of structures is limited to those having only electric response, with an electric permittivity always equal to or greater than unity, there are still numerous metamaterial design possibilities enabled by leveraging the non-resonant elements. For example, a gradient, impedance matching layer can be added that drastically reduces the return loss of the optical elements, making them essentially reflectionless and lossless. In microwave experiments, we demonstrate the broadband design concepts with a gradient index lens and a beam-steering element, both of which are confirmed to operate over the entire X-band (roughly 8-12 GHz) frequency spectrum.

Because the electromagnetic response of metamaterial elements can be precisely controlled, they can be viewed as the fundamental building blocks for a wide range of complex, electromagnetic media. To date, metamaterials have commonly been formed from resonant conducting circuits, whose dimensions and spacing are much less than the wavelength of operation. By engineering the large dipolar response of these resonant elements, an unprecedented range of effective material response can be realized, including artificial magnetism and large positive and negative values of the effective permittivity and permeability tensor elements.

Leveraging the flexibility inherent in these resonant elements, metamaterials have been used to implement structures that would have been otherwise difficult or impossible to achieve using conventional materials. Negative index materials, for example, sparked a surge of interest in metamaterials, since negative refractive index is not a material property available in nature. Still, as remarkable as negative index media are, they represented only the beginning of the possibilities available with artificially structured media. Inhomogeneous media, in which the material properties vary in a controlled manner throughout space, also can be used to develop optical components, and are an extremely good match for implementation by metamaterials. Indeed, gradient index optical elements have already been demonstrated at microwave frequencies in numerous experiments. Moreover, since metamaterials allow unprecedented freedom to control the constitutive tensor elements independently, point-by-point throughout a region of space, metamaterials can be used as the technology to realize structures designed by the method of transformation optics [1]. The "invisibility" cloak, demonstrated at microwave frequencies in 2006, is an example of a metamaterials [2].

Although metamaterials have proven successful in the realization of unusual electromagnetic response, the structures demonstrated are often of only marginal utility in practical applications due to the large losses that are inherent to the resonant elements most typically used. The situation can be illustrated using the curves presented in FIG. A1, in which the effective constitutive parameters are shown in FIGS. A1 (*a*) and (*b*) for the metamaterial unit cell in the inset. According to the effective medium theory described in Ref. [3], the retrieved curves are significantly affected by spatial dispersion effect. To remove the spatial dispersion factor, we can apply the formulas in the theorem [3] and achieve that $$\bar{\epsilon}=\epsilon\ \sin(\theta)/\theta$$

$$\bar{\mu}=\mu\ \tan(\theta/2)/(\theta/2) \tag{1}$$

in which, $\theta=\omega\rho\sqrt{\bar{\epsilon}\bar{\mu}}$ and $\rho$ is the periodicity of the unit cell.

FIG. A1 (*c*) shows $\overline{\in}$ with frequency and the regular Drude-Lorentz resonant form after removing the spatial dispersion factor.

FIG. A1. (a) Retrieved permittivity for a metamaterial composed of the repeated unit cell shown in the inset; (b) retrieved permeability for a metamaterial composed of the repeated unit cell shown in the inset. (c) The distortions and artifacts in the retrieved parameters are due to spatial dispersion, which can be removed to find the Drude-Lorentz like resonance shown in the lower figure.

Note that the unit cell possesses a resonance in the permittivity at a frequency near 42 GHz. In addition to the resonance in the permittivity, there is also structure in the magnetic permeability. These artifacts are phenomena related to spatial dispersion—an effect due to the finite size of the unit cell with respect to the wavelengths. As previously pointed out, the effects of spatial dispersion are simply described analytically, and can thus be removed to reveal a relatively uncomplicated Drude-Lorentz type oscillator characterized by only a few parameters. The observed resonance takes the form $$\varepsilon(\omega) = 1 - \frac{\omega_p^2}{\omega^2 - \omega_0^2 + i\Gamma\omega} = \frac{\omega^2 - \omega_0^2 - \omega_p^2 - i\Gamma\omega}{\omega^2 - \omega_0^2 + i\Gamma\omega}, \tag{2}$$

where $\omega_p$ is the plasma frequency, $\omega_O$ is the resonance frequency and $\Gamma$ is a damping factor. The frequency where $\in(\omega)=0$ occurs at $\omega_L^2=\omega_0^2+\omega_p^2$.

As can be seen from either Eq. 2 or FIG. A1, the effective permittivity can achieve very large values, either positive or negative, near the resonance. Yet, these values are inherently accompanied by both dispersion and relatively large losses, especially for frequencies very close to the resonance frequency. Thus, although a very wide and interesting range of constitutive parameters can be accessed by working with metamaterial elements near the resonance, the advantage of these values is somewhat tempered by the inherent loss and dispersion. The strategy in utilizing metamaterials in this regime is to reduce the losses of the unit cell as much as possible. Because the skin depth of a metal . . . .

If we examine the response of the electric metamaterial shown in FIG. A1 at very low frequencies, we find, in the zero frequency limit, $$\varepsilon(\omega \to 0) = 1 + \frac{\omega_p^2}{\omega_0^2} = \frac{\omega_L^2}{\omega_0^2} \tag{3}$$

The equation is reminiscent of the Lyddane-Sachs-Teller relation that describes the contribution of the polariton resonance to the dielectric constant at zero frequency [4]. At frequencies far away from the resonance, we see that the permittivity approaches a constant that differs from unity by the square of the ratio of the plasma to the resonance frequencies. Although the values of the permittivity are necessarily positive and greater than unity, the permittivity is both dispersionless and lossless—a considerable advantage. Note that this property does not extend to magnetic metamaterial media, such as split ring resonators, which are generally characterized by effective permeability of the form $$\mu(\omega) = 1 - \frac{F\omega^2}{\omega^2 - \omega_0^2 + i\Gamma\omega}, \tag{4}$$

which approaches unity in the low frequency limit. Because artificial magnetic effects are based on induction rather than polarization, artificial magnetic response must vanish at zero frequency.

The effective constitutive parameters of metamaterials are not only complicated by spatial dispersion but also possess an infinite number of higher order resonances that should properly be represented as a sum over oscillators. It is thus expected that the simple analytical formulas presented above are only approximate. Still, we can investigate the general trend of the low frequency permittivity as a function of the high-frequency resonance properties of the unit cell. By adjusting the dimension of the square closed ring in the unit cell, we can compare the retrieved zero-frequency permittivity with that predicted by Eq. 2. The simulations are carried out using HFSS (Ansoft), a commercial electromagnetic, finite-element, solver that can determine the exact field distributions and scattering (S-) parameters for an arbitrary metamaterial structure. The permittivity and permeability can be retrieved from the S-parameters by a well-established algorithm. Table I demonstrates the comparison between such simulated extraction and theoretical prediction. We should notice that as the unit cell is combined with a dielectric substrate, Eq. (3) has been modified into $$\varepsilon(\omega \to 0) = \varepsilon_a\left(1 + \frac{\omega_p^2}{\omega_0^2}\right) = \varepsilon_a \frac{\omega_L^2}{\omega_0^2},$$

in which, $\in_a=1.9$. The additional fitting parameter can represent the practical situation of the affect from substrate dielectric constant and the contribution to DC permittivity from high order resonances. Though there is significant disagreement between the predicted and retrieved values of permittivity, the values are of similar order and show clearly a similar trend: the high frequency resonance properties are strongly correlated to the zero frequency polarizability. By modifying the high-frequency resonance properties of the element, the zero- and low-frequency permittivity can be adjusted to arbitrary values.

TABLE I

The predicted and actual zero-frequency permittivity values as a function of the until cell dimension. a.

| a | $f_0$ | $f_L$ | $\varepsilon_{predicted}$ | $\varepsilon_{actual}$ |
|---|---|---|---|---|
| 1.70 | 44.0 | 59.0 | 3.416 | 3.425 |
| 1.55 | 54.0 | 64.0 | 2.670 | 2.720 |
| 1.40 | 64.0 | 71.0 | 2.338 | 2.315 |
| 1.20 | 77.4 | 79.2 | 1.989 | 1.885 |

Because the closed ring design shown in FIG. A 2 can easily be tuned to provide a range of dielectric values, we utilize it as the base element to illustrate more complex gradient-index structures. Though its primary response is electric, the closed ring also possesses a weak, diamagnetic response that is induced when the incident magnetic field lies along the ring axis. The closed ring medium therefore is characterized by a magnetic permeability that differs from unity, and which must be taken into account for a full description of the material properties. The presence of both electric and magnetic dipolar responses is generally useful in designing complex media, having been demonstrated in the metamaterial cloak. By changing the dimensions of the ring, it is possible to control the contribution of the magnetic response.

The permittivity can be accurately controlled by changing the geometry of the closed ring. The electric response of the closed ring structure is identical to the "cut-wire" structure previously studied, where it has been shown that the plasma and resonance frequencies are simply related to circuit parameters according to $$\omega_p^2 \approx \frac{1}{L} \text{ and } \omega_0^2 \approx \frac{1}{LC}.$$

Here, L is the inductance associated with the arms of the closed ring and C is the capacitance associated with the gap between adjacent closed rings. For a fixed unit cell size, the inductance can be tuned either by changing the thickness, w, of the conducting rings or their length, a. The capacitance can be controlled primarily by changing the overall size of the ring.

FIG. A2. (Color online) Retrieval results for the closed ring medium. In all cases the radius of curvature of the corners is 0.6 mm, and w=0.2 mm. (a) The extracted permittivity with a=1.4 mm. (b) The extracted index and impedance for several values of a. The low frequency region is shown. (c) The relationship between the dimension a and the extracted refractive index and wave impedance.

Changing the resonance properties in turn changes the low frequency permittivity value, as illustrated by the simulation results presented in FIG. A2. The closed ring structure shown in FIG. A2(*a*) is assumed to be deposited on FR4 substrate, whose permittivity is 3.85+i0.02 and thickness is 0.2026 mm. The unit cell dimension is 2 mm, and the thickness of the deposited metal layer (assumed to be copper) is 0.018 mm. For this structure, a resonance occurs near 25 GHz with the permittivity nearly constant over a large frequency region (roughly zero to 15 GHz). Simulations of three different unit cell with ring dimensions of a=0.7 mm, 1.4 mm and 1.625 mm were also simulated to illustrate the effect on the material parameters. In FIG. A2*b*, it is observed that the index value becomes larger as the ring dimension is increased, reflecting the larger polarizability of the larger rings.

The refractive index remains, for the most part, relatively flat as a function of frequency for frequencies well below the resonance. The index does exhibit a slight monotonic increase as a function of frequency, however, which is due to the higher frequency resonance. The impedance changes also exhibits some amount of frequency dispersion, due to the effects of spatial dispersion on the permittivity and permeability. The losses in this structure are found to be negligible, as a result of being far away from the resonance frequency. This result is especially striking, because the substrate is not one optimized for RF circuits—in fact, the FR4 circuit board substrate assumed here is generally considered quite lossy.

As can be seen from the simulation results in FIG. A2, metamaterial structures based on the closed ring element should be nearly non-dispersive and low-loss, provided the resonances of the elements are sufficiently above the desired range of operating frequencies. To illustrate the point, we make use of the closed ring element to realize two gradient index devices: a gradient index lens and a beam steering lens. The use of resonant metamaterials to implement positive and negative gradient index structures was introduced in [5] and subsequently applied in various contexts. The design approach is first to determine the desired continuous index profile to accomplish the desired function (e.g., focusing or steering) and then to stepwise approximate the index profile using a discrete number of metamaterial elements. The elements can be designed by performing numerical simulations for a large number of variations of the geometrical parameters of the unit cell (i.e., a, w, etc.); once enough simulations have been run so that a reasonable interpolation can be formed of the permittivity as a function of the geometrical parameters, the metamaterial gradient index structure can be laid out and fabricated. This basic approach has been followed in [6].

Two gradient index samples were designed to test the bandwidth of the non-resonant metamaterials. The color maps in FIG. A3 show the index distribution corresponding to the beam steering layer (FIG. A3*a*) and the beam focusing lens (FIG. A3*b*). Although the gradient index distributions provide the desired function of either focusing or steering a beam, there remains a substantial mismatch between the predominantly high index structure and free-space. This mismatch was managed in prior demonstrations by adjusting the properties of each metamaterial element such that the permittivity and permeability were essentially equal. This flexibility in design is an inherent advantage of resonant metamaterials, where the permeability response can be engineered on a nearly equal footing with the electric response. By contrast, that flexibility is not available for designs involving non-resonant elements, so we have instead made use of a gradient index impedance matching layer (IML) to provide a match from free-space to the lens, as well as a match from the exit of the lens back to free space.

FIG. A3. Refractive index distributions for the designed gradient index structures. (a) A beam-steering element based on a linear index gradient. (b) A beam focusing lens, based on a higher order polynomial index gradient. Note the presence in both designs of an impedance matching layer (IML), provided to improve the insertion loss of the structures.

FIG. A4. Fabricated sample, in which, the metamaterial structures vary with space coordinate.

The beam steering layer is a slab with a linear index gradient in the direction transverse to the direction of wave propagation. The index values range from n=1.16 to n=1.66, consistent with the range available from our designed set of closed ring metamaterial elements. To improve the insertion loss and to minimize reflection, the IML is placed on both sides of the sample (input and output). The index values of the IML gradually change from unity (air) to n=1.41, the index value at the center of the beam steering slab. This index value was chosen because most of the energy of the collimated beam passes through the center of the sample. To implement the actual beam steering sample, we made use of the closed ring unit cell shown in FIG. A2 and designed an array of unit cells having the distribution shown in FIG. A3*a*.

The beam focusing lens is a planar slab with the index distribution as represented in FIG. A3*b*. The index distribution has the functional form of $$Re(n)=4\times10^{-6}|x|^3-5\times10^{-4}|x|^2-6\times10^{-4}|x|+1.75, \quad (5)$$

in which x is the distance away from the center of the lens. Once again, an IML was used to match the sample to free space. In this case, the index profile in the IML was ramped linearly from n=1.15 to n=1.75, the latter value selected to match the index at the center of the lens. The same unit cell design was utilized for the beam focusing lens as for the beam steering lens.

To confirm the properties of the gradient index structures, we fabricated the two designed samples using copper clad FR4 printed circuit board substrate, shown in FIG. A4.

Following a procedure previously described, sheets of the samples were fabricated by standard optical lithography, then cut into 1 cm tall strips that could be assembled together to form the gradient index slabs. To measure the sample, we placed them into a 2D mapping apparatus, which has been described in details5 and mapped the near field distribution [7].

FIG. A5. Field mapping measurements of the beam steering lens. The lens has a linear gradient that causes the incoming beam to be deflected by an angle of 16.2 degrees. The effect is broadband, as can be seen from the identical maps taken at four different frequencies that span the X-band range of the experimental apparatus.

FIG. A6. Field mapping measurements of the beam focusing lens. The lens has a symmetric profile about the center (given in the text) that causes the incoming beam to be focused to a point. Once again, the function is broadband, as can be seen from the identical maps taken at four different frequencies that span the X-band range of the experimental apparatus.

FIG. A5 shows the beam steering of the ultra-broadband metamaterial design, in which, a large broadband is covered. The actual bandwidth starts from DC and goes up to approximately 14 GHz. From FIG. A3, it is obvious that beam steering occurs at all the four different frequencies from 7.38 GHz to 11.72 GHz with an identical steering angle of 16.2 degrees. The energy loss through propagation is extremely low and can barely be observed. FIG. A6 shows the mapping result of the beam focusing sample. Broadband property is demonstrated again at four different frequencies with an exact same focal distance of 35 mm and low loss.

In summary, we proposed ultra-broadband metamaterials, based on which complex inhomogeneous material can be realized and accurately controlled. The configuration of ultra-broadband metamaterials and the design approach are validated by experiments. Due to its low loss, designable properties and easy access to inhomogeneous material parameters, the ultra-broadband metamaterials will find wide applications in the future.

REFERENCES

[1] J. B. Pendry, D. Schurig, D. R. Smith Science 312, 1780 (2006).

[2] D. Schurig, J. J. Mock, B. J. Justice, S. A. Cumlller, J. B. Pendry, A. F. Starr and D. R. Smith, Science 314, 977-980 (2006).

[3] R. Liu, T. J. Cui, D. Huang, B. Zhao, D. R. Smith, Physical Review E 76, 026606 (2007).

[4] C. Kinel, *Solid State Physics* (John Wiley & Sons, New York, 1986), $6^{th}$ ed., p. 275.

[5] D. R. Smith, P. M. Rye, J. J. Mock, D. C. Vier, A. F. Starr *Physical Review Letters,* 93, 137405 (2004).

[6] T. Driscoll, et. al. Applied Physics Letters 88, 081101 (2006).

[7] B. J. Justice, J. J. Mock, L. Guo, A. Degiron, D. Schurig, D. R. Smith, Optics Express 14, 8694 (2006).

We claim:

1. An apparatus, comprising:

a continuous conducting surface having a plurality of openings, each opening complemented by a discrete conducting patch separated from the continuous conducting surface, the plurality of openings and patches providing an effective permeability in a direction parallel to the continuous conducting surface, wherein the effective permeability is less than zero;

wherein the continuous conducting surface is a bounding surface of a parallel plate waveguide structure, and the effective permeability is an effective permeability for transverse electromagnetic (TEM) waves that propagate within the waveguide structure and parallel to the continuous conducting surface; and wherein the plurality of openings and patches provides a spatially-varying effective refractive index for the TEM waves.

2. An apparatus, comprising:

a continuous conducting surface having a plurality of openings, each opening complemented by a discrete conducting patch separated from the continuous conducting surface, the plurality of openings and patches providing an effective permeability in a direction parallel to the continuous conducting surface, wherein the effective permeability in the direction parallel to the continuous conducting surface is a first effective permeability in a first direction parallel to the continuous conducting surface, and the plurality of openings and patches further provides a second effective permeability in a second direction parallel to the continuous conducting surface and perpendicular to the first direction; and wherein the continuous conducting surface is a bounding surface of a parallel plate waveguide structure, and the effective permeability is an effective permeability for transverse electromagnetic (TEM) waves that propagate within the waveguide structure and parallel to the continuous conducting surface; and wherein the plurality of openings and patches provides a spatially-varying effective refractive index for the TEM waves.

3. The apparatus of claim 2, wherein the first effective permeability is substantially equal to the second effective permeability.

4. The apparatus of claim 2, wherein the first effective permeability is substantially different than the second effective permeability.

5. The apparatus of claim 4, wherein the first effective permeability is greater than zero, and the second effective permeability is less than zero.

6. An apparatus, comprising:

a continuous conducting surface having a plurality of openings, each opening complemented by a discrete conducting patch separated from the continuous conducting surface, the plurality of openings and patches providing a spatially-varying effective refractive index;

wherein the continuous conducting surface is a bounding surface of a parallel plate waveguide structure, and the spatially-varying effective refractive index is a spatially-varying effective refractive index for transverse electromagnetic (TEM) waves that propagate within the waveguide structure and parallel to the continuous conducting surface; and wherein the waveguide structure defines an input port for receiving input electromagnetic energy, and an output port for transmitting output electromagnetic energy.

7. The apparatus of claim 6, wherein the waveguide structure is a substantially planar two-dimensional waveguide structure.

8. The apparatus of claim 6, wherein the input port defines an input port impedance for substantial nonreflection of input electromagnetic energy.

9. The apparatus of claim 8, wherein the plurality of respective individual electromagnetic responses further provides an effective wave impedance that gradiently approaches the input port impedance at the input port.

10. The apparatus of claim 6, wherein the output port defines an output port impedance for substantial nonreflection of output electromagnetic energy.

11. The apparatus of claim 6, wherein the plurality of respective individual electromagnetic responses further provides an effective wave impedance that gradiently approaches the output port impedance at the output port.

12. The apparatus of claim 6, wherein the waveguide structure is responsive to a substantially collimated beam of input electromagnetic energy defining an input beam direction to provide a substantially collimated beam of output electromagnetic energy defining an output beam direction substantially different than the input beam direction.

13. The apparatus of claim 12, wherein the waveguide structure defines an axial direction directed from the input port to the output port, and the spatially-varying effective refractive index includes, intermediate the input port and the output port, a substantially linear gradient along a direction perpendicular to the axial direction.

14. The apparatus of claim 6, wherein the waveguide structure is responsive to a substantially collimated beam of input electromagnetic energy to provide a substantially converging beam of output electromagnetic energy.

15. The apparatus of claim 14, wherein the waveguide structure defines an axial direction directed from the input port to the output port, and the spatially-varying effective refractive index includes, intermediate the input port and the output port, a substantially concave variation along a direction perpendicular to the axial direction.

16. The apparatus of claim 6, wherein the waveguide structure is responsive to a substantially collimated beam of input electromagnetic energy to provide a substantially diverging beam of output electromagnetic energy.

17. The apparatus of claim 16, wherein the waveguide structure defines an axial direction directed from the input port to the output port, and the spatially-varying effective refractive index includes, intermediate the input port and the output port, a substantially convex variation along a direction perpendicular to the axial direction.

18. The apparatus of claim 6, further comprising:

one or more patch antennas coupled to the output port.

19. The apparatus of claim 18, further comprising:

one or more electromagnetic emitters coupled to the input port.

20. The apparatus of claim 19, wherein the one or more adjustable effective medium parameters includes an adjustable effective permittivity.

21. The apparatus of claim 19, wherein the one or more adjustable effective medium parameters includes an adjustable effective permeability.

22. The apparatus of claim 19, wherein the one or more adjustable effective medium parameters includes an adjustable effective refractive index.

23. The apparatus of claim 22, wherein the one or more external inputs includes one or more voltage inputs.

24. The apparatus of claim 22, wherein the one or more external inputs includes one or more optical inputs.

25. The apparatus of claim 22, wherein the one or more external inputs includes an external magnetic field.

26. The apparatus of claim 19, wherein the one or more adjustable effective medium parameters includes an adjustable effective wave impedance.

27. The apparatus of claim 19, wherein the adjustable individual electromagnetic responses are adjustable by one or more external inputs.

28. The apparatus of claim 6, further comprising:

one or more electromagnetic receivers coupled to the input port.

29. An apparatus, comprising:

a continuous conducting surface having a plurality of adjustable openings, each adjustable opening complemented by a discrete conducting patch separated from the continuous conducting surface, the plurality of adjustable openings and patches providing adjustable effective medium parameters, wherein the continuous conducting surface is a bounding surface of a parallel plate waveguide structure, and the adjustable effective medium parameters are adjustable effective medium parameters for transverse electromagnetic (TEM) waves that propagate within the waveguide structure and parallel to the continuous conducting surface.

30. A method, comprising:

selecting a transverse electromagnetic (TEM) function; and determining respective physical parameters for a plurality of openings in a continuous conducting surface, each opening complemented by a discrete conducting patch separated from the continuous conducting surface, providing an effective permeability in a direction parallel to the continuous conducting surface, wherein the effective permeability is less than zero, positionable in the continuous conducting surface to provide the TEM function as an effective medium response, wherein the TEM function is a waveguide beam-steering function for a guided TEM wave that propagates parallel to the continuous conducting surface, wherein the continuous conducting surface is a bounding surface of a parallel plate waveguide structure, and wherein the plurality of openings and patches provides a spatially-varying effective refractive index for TEM waves.

31. The method of claim 30, wherein the waveguide beam-steering function defines a beam deflection angle, and the selecting of the waveguide beam-steering function includes a selecting of the beam deflection angle.

32. A method, comprising:

selecting a transverse electromagnetic (TEM) function; and determining respective physical parameters for a plurality of openings in a continuous conducting surface, each opening complemented by a discrete conducting patch separated from the continuous conducting surface, providing an effective permeability in a direction parallel to the continuous conducting surface, wherein the effective permeability is less than zero, positionable in the continuous conducting surface to provide the TEM function as an effective medium response, wherein the TEM function is a waveguide beam-focusing function for a guided TEM wave that propagates parallel to the continuous conducting surface, wherein the continuous conducting surface is a bounding surface of a parallel plate waveguide structure, and wherein the plurality of openings and patches provides a spatially-varying effective refractive index for TEM waves.

33. The method of claim 32, wherein the waveguide beam-focusing function defines a focal length, and the selecting of the waveguide beam-focusing function includes a selecting of the focal length.

34. A method, comprising:

selecting a transverse electromagnetic (TEM) function; and determining respective physical parameters for a plurality of openings in a continuous conducting surface, each opening complemented by a discrete conducting patch separated from the continuous conducting surface, providing an effective permeability in a direction parallel to the continuous conducting surface, wherein the effective permeability is less than zero, positionable in the continuous conducting surface to provide the TEM function as an effective medium response, wherein the TEM function is an antenna array phase-shifting function for the plurality of openings and patches fed by a guided TEM wave that propagates parallel to the continuous conducting surface, wherein the continuous conducting surface is a bounding surface of a parallel plate waveguide structure, and wherein the plurality of openings and patches providing a spatially-varying effective refractive index for TEM waves.

35. A method, comprising:

selecting a pattern of electromagnetic medium parameters; and for a continuous conducting surface having a plurality of openings, each opening complemented by a discrete conducting patch separated from the continuous conducting surface, providing an effective permeability in a direction parallel to the continuous conducting surface, wherein the effective permeability is less than zero, with respective adjustable physical parameters, determining respective values of the respective adjustable physical parameters to provide a pattern of effective electromagnetic medium parameters that corresponds to the pattern of electromagnetic medium parameters, wherein the continuous conducting surface is a bounding surface of a parallel plate waveguide structure, and the pattern of effective electromagnetic medium parameters is a pattern of effective electromagnetic medium parameters for transverse electromagnetic (TEM) waves that propagate within the waveguide structure and parallel to the continuous conducting surface, and wherein the plurality of openings and patches provides a spatially-varying effective refractive index for the TEM waves.

36. The method of claim 35, wherein the respective adjustable physical parameters are functions of one or more control inputs, and the method includes:

providing the one or more control inputs corresponding to the determined respective values of the respective adjustable physical parameters.

37. The method of claim 35, wherein the determining includes determining according to one of a regression analysis and a lookup table.

38. A method, comprising:

selecting a transverse electromagnetic (TEM) function; and for a continuous conducting surface having a plurality of openings, each opening complemented by a discrete conducting patch separated from the continuous conducting surface, providing an effective permeability in a direction parallel to the continuous conducting surface, wherein the effective permeability is less than zero, with respective adjustable physical parameters, determining respective values of the respective adjustable physical parameters to provide the TEM function as an effective medium response, wherein the continuous conducting surface is a bounding surface of a parallel plate waveguide structure, and the effective medium response is an effective medium response for transverse electromagnetic (TEM) waves that propagate within the waveguide structure and parallel to the continuous conducting surface, and wherein the plurality of openings and patches provides a spatially-varying effective refractive index for TEM waves.

39. The method of claim 38, wherein the respective adjustable physical parameters are functions of one or more control inputs, and the method includes:

providing the one or more control inputs corresponding to the determined respective values of the respective adjustable physical parameters.

40. The method of claim 38, wherein the determining includes determining according to one of a regression analysis and a lookup table.

* * * * *